US007681507B2

(12) United States Patent
Herzog et al.

(10) Patent No.: US 7,681,507 B2
(45) Date of Patent: Mar. 23, 2010

(54) RAILCAR WITH DISCHARGE CONTROL SYSTEM

(75) Inventors: John C. Herzog, West Chester, OH (US); D. Bruce Fetterman, Arlington, TX (US); Robert J. Cencer, Brooklyn, MI (US); Joseph M. Sindelar, Houston, TX (US); George S. Creighton, Flower Mound, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 11/381,687

(22) Filed: May 4, 2006

(65) Prior Publication Data

US 2006/0185552 A1 Aug. 24, 2006

Related U.S. Application Data

(63) Continuation of application No. 10/926,370, filed on Aug. 25, 2004, now Pat. No. 7,051,661.

(60) Provisional application No. 60/498,117, filed on Aug. 26, 2003.

(51) Int. Cl.
*B61D 3/00* (2006.01)

(52) U.S. Cl. ..... 105/286

(58) Field of Classification Search ..... 105/286, 105/287, 288, 290, 280, 247, 248
See application file for complete search history.

(56) References Cited

U.S. PATENT DOCUMENTS 215,625 A 5/1879 Jauriet ..... 62/423
686,902 A 11/1901 Muller et al. ..... 105/290
707,416 A 8/1902 Hornbrook et al.
728,029 A 5/1903 Shephard
775,402 A 11/1904 Hitchcock ..... 105/290

(Continued)

FOREIGN PATENT DOCUMENTS

GB 7564 * 0/1910

(Continued)

OTHER PUBLICATIONS

Equipment Diagram for Unrestricted Interchange Service Standard, Association of American Railroads, Plate F, Apr. 1, 1978, May 1, 1976.

(Continued)

*Primary Examiner*—S. Joseph Morano
*Assistant Examiner*—Robert J McCarry, Jr.
(74) *Attorney, Agent, or Firm*—Baker Botts L.L.P.

(57) ABSTRACT

A railcar with discharge control system is disclosed. In one embodiment, a railway car includes an underframe and at least one hopper for transporting lading. The railway car further including the underframe including a center sill which defines in part a longitudinal axis of the railway car. A discharge opening formed proximate to a lower portion of the hopper. A respective door assembly pivotally mounted adjacent to the discharge opening to control the flow of lading from the hopper. The door assembly operable for movement between a first, closed position and a second, open position relative to the discharge opening. A discharge control system operable to move the door assembly between the first position and the second position. The discharge control system operably moves generally longitudinally along the axis of the railway car to move the door assemblies between the first, closed position and the second, open position.

10 Claims, 13 Drawing Sheets

U.S. PATENT DOCUMENTS

| | | | | | |
|---|---|---|---|---|---|
| 971,603 | A | | 10/1910 | Goodwin | |
| 1,076,011 | A | | 10/1913 | Campbell | |
| 1,085,058 | A | | 1/1914 | Messick | |
| 1,092,659 | A | | 4/1914 | Mettler | |
| 1,164,918 | A | | 12/1915 | Campbell | |
| 1,209,809 | A | | 12/1916 | Campbell | |
| 1,212,043 | A | | 1/1917 | Freeman et al. | |
| 1,284,111 | A | | 11/1918 | Kestler | |
| 1,330,361 | A | | 2/1920 | Todd | |
| 1,405,415 | A | | 2/1922 | Houchberg | 105/251 |
| 1,482,559 | A | | 2/1924 | Hart | |
| 1,494,579 | A | | 5/1924 | Bohn | 49/489.1 |
| 1,801,564 | A | | 4/1931 | Muffly | 220/592.07 |
| 2,011,155 | A | | 8/1935 | Neikirk | 105/415 |
| 2,047,133 | A | | 7/1936 | Christianson et al. | 105/409 |
| 2,167,362 | A | | 7/1939 | Hindahl | |
| 2,169,692 | A | | 8/1939 | Hansen | |
| 2,269,631 | A | | 1/1942 | Marinello | 105/377.09 |
| 2,605,064 | A | | 7/1952 | Davis | 244/118 |
| 2,684,642 | A | * | 7/1954 | Dorey George B | 105/251 |
| 2,716,383 | A | | 8/1955 | Malcolm | 410/112 |
| 2,756,693 | A | | 7/1956 | Frost | 105/369 |
| 2,888,883 | A | | 6/1959 | Fritz et al. | 105/250 |
| 3,137,247 | A | | 6/1964 | Hamilton et al. | 105/251 |
| 3,179,068 | A | | 4/1965 | Jensen | 105/369 |
| 3,288,531 | A | | 11/1966 | Bartsch | |
| 3,316,858 | A | | 5/1967 | Fritz | |
| 3,343,725 | A | | 9/1967 | Cannon | 122/129 |
| 3,408,956 | A | | 11/1968 | Rebenok et al. | 105/240 |
| 3,434,433 | A | | 3/1969 | Floehr | 105/249 |
| 3,447,485 | A | | 6/1969 | Dorey | |
| 3,455,253 | A | | 7/1969 | Floehr | 105/251 |
| 3,468,062 | A | | 9/1969 | Hennessy | 49/362 |
| 3,468,063 | A | | 9/1969 | Hennessy | 49/362 |
| 3,501,030 | A | | 3/1970 | Flink | 214/17 |
| 3,581,672 | A | | 6/1971 | Aquino | 105/240 |
| 3,601,453 | A | | 8/1971 | Silverman | 303/89 |
| 3,610,485 | A | | 10/1971 | Van Raden | 222/564 |
| 3,624,761 | A | | 11/1971 | Kohn | 180/112 |
| 3,626,865 | A | | 12/1971 | Aquino et al. | 105/240 |
| 3,636,658 | A | | 1/1972 | Bollinger, Sr. | 49/362 |
| 3,656,437 | A | | 4/1972 | Kuzmicki | 105/240 |
| 3,683,552 | A | | 8/1972 | Bollinger, Sr. | 49/209 |
| 3,730,360 | A | | 5/1973 | Aquino et al. | 414/270 |
| 3,746,388 | A | | 7/1973 | Robinson | 296/181.6 |
| 3,762,341 | A | | 10/1973 | Adler | 410/103 |
| 3,789,772 | A | | 2/1974 | Bullard | 105/240 |
| 3,796,007 | A | | 3/1974 | Bollinger, Sr. et al. | 49/362 |
| 3,800,711 | A | * | 4/1974 | Tuttle, James H. | 105/251 |
| 3,802,356 | A | | 4/1974 | Hasselof et al. | 105/376 |
| 3,837,296 | A | | 9/1974 | Loomis | 105/376 |
| 3,843,081 | A | | 10/1974 | Meier et al. | 248/223 |
| 3,883,992 | A | | 5/1975 | Bollinger, Sr. | 49/362 |
| 3,917,338 | A | | 11/1975 | Becker | 410/116 |
| 3,923,327 | A | | 12/1975 | Ross, Jr. | 292/39 |
| 3,949,681 | A | | 4/1976 | Miller | 105/284 |
| 3,965,760 | A | | 6/1976 | Etheredge, Jr. | 74/89.14 |
| 3,990,184 | A | | 11/1976 | Bollinger, Sr. | 49/218 |
| 3,996,591 | A | | 12/1976 | Hayward | 343/225 |
| 4,021,066 | A | | 5/1977 | McShane | 292/144 |
| 4,114,318 | A | | 9/1978 | Brindle | 49/215 |
| 4,136,621 | A | | 1/1979 | Schuller et al. | 105/308 |
| 4,138,948 | A | | 2/1979 | Korolis | 105/251 |
| 4,145,080 | A | | 3/1979 | Miller et al. | 296/24.35 |
| 4,167,144 | A | | 9/1979 | Martin et al. | 105/467 |
| 4,168,667 | A | | 9/1979 | Loomis | 105/467 |
| 4,224,877 | A | * | 9/1980 | Stark et al. | 105/250 |
| 4,227,732 | A | | 10/1980 | Kish | 294/71 |
| 4,235,169 | A | | 11/1980 | Peterson | 105/251 |
| 4,246,849 | A | | 1/1981 | Gramse | 105/251 |
| 4,250,814 | A | | 2/1981 | Stark et al. | 105/251 |
| 4,262,601 | A | * | 4/1981 | Miller | 105/241.2 |
| 4,342,267 | A | | 8/1982 | Blout | 105/282 |
| 4,400,914 | A | | 8/1983 | Hennessy | 49/362 |
| 4,417,526 | A | | 11/1983 | Marulic et al. | 105/406.1 |
| 4,450,773 | A | | 5/1984 | Fritz et al. | 105/282 |
| 4,491,354 | A | | 1/1985 | Williams | 292/148 |
| 4,580,502 | A | | 4/1986 | Ritzl et al. | 105/240 |
| 4,601,244 | A | * | 7/1986 | Fischer | 105/240 |
| 4,754,710 | A | | 7/1988 | Kieres | 105/355 |
| 4,766,820 | A | * | 8/1988 | Ritter et al. | 105/240 |
| 4,829,908 | A | * | 5/1989 | Hallam | 105/240 |
| 4,930,427 | A | | 6/1990 | Ritter et al. | 105/406.1 |
| 4,986,590 | A | | 1/1991 | Patti et al. | 296/39.2 |
| 5,077,459 | A | | 12/1991 | Heumiller | 219/117.1 |
| 5,115,748 | A | | 5/1992 | Westlake | 105/286 |
| 5,144,895 | A | | 9/1992 | Murray | 105/286 |
| 5,163,372 | A | | 11/1992 | Galvan et al. | 105/240 |
| 5,177,988 | A | | 1/1993 | Bushnell | 70/279 |
| 5,261,333 | A | | 11/1993 | Miller | 105/287 |
| 5,263,422 | A | | 11/1993 | Barefoot | 105/308.1 |
| 5,351,582 | A | | 10/1994 | Snyder et al. | 81/57.17 |
| 6,279,487 | B1 | * | 8/2001 | Gaydos et al. | 105/289 |
| 6,367,391 | B1 | | 4/2002 | Thoman et al. | 105/404 |
| 6,374,546 | B1 | | 4/2002 | Fecko et al. | 52/17 |
| 6,402,446 | B1 | | 6/2002 | Nadherny et al. | 410/100 |
| 6,422,794 | B1 | | 7/2002 | Zhan et al. | 410/100 |
| 6,450,105 | B1 | | 9/2002 | Glass | 105/404 |
| 6,481,941 | B2 | | 11/2002 | Nadherny et al. | 410/114 |
| 6,494,651 | B1 | | 12/2002 | Zhan et al. | 410/116 |
| 6,575,102 | B2 | | 6/2003 | Norton et al. | 105/423 |
| 6,585,466 | B2 | | 7/2003 | Zhan et al. | 410/116 |
| 6,609,583 | B2 | | 8/2003 | Schillaci et al. | 180/69.21 |
| 6,615,741 | B2 | | 9/2003 | Fecko et al. | 105/404 |
| 6,626,623 | B2 | | 9/2003 | DeLay | 410/116 |
| 6,655,886 | B2 | | 12/2003 | Grandy | 410/112 |
| 6,709,209 | B2 | | 3/2004 | Zhan et al. | 410/116 |
| 6,712,568 | B2 | | 3/2004 | Snyder et al. | 410/104 |
| 6,722,287 | B2 | | 4/2004 | Norton et al. | 105/404 |
| 6,748,841 | B1 | | 6/2004 | Fritz | 87/57.41 |
| 6,761,840 | B2 | | 7/2004 | Fecko et al. | 52/17 |
| 6,955,126 | B2 | | 10/2005 | Taylor | 105/250 |
| 6,955,127 | B2 | | 10/2005 | Taylor | 105/299 |
| 7,051,661 | B2 | | 5/2006 | Herzog et al. | 105/286 |
| 7,080,599 | B2 | | 7/2006 | Taylor | 105/290 |

FOREIGN PATENT DOCUMENTS

GB J07564 A 0/1910

OTHER PUBLICATIONS

PCT International Search, PCT US2004/027519, 8 pages, Aug. 26, 2003.

PCT International Search, PCT US2004/027508, 12 pages, Aug. 26, 2003.

"IRECO Boxcar Lading Tie Anchor", at http://www/ireco.com/BoxcarLadingAnchors2761_3648.htm, 2 pages. Dec. 15, 2003.

Invitation to Pay Additional Fees; PCT/US2004/027508; 6 pages, Jun. 12, 2004.

"What is Vacuum Insulation? Vacuum Insulation [VI] Explained . . . ", at http://www.estglobal.com/tech-vip.html, 2 pages, Oct. 5, 2004.

Notification of Transmittal of The International Search Report and The Written Opinion of the International Searching Authority for PCT/US2004/027519; 14 pages, Nov. 30, 2004.

Notification of Transmittal of The International Search Report and The Written Opinion of the International Searching Authority for PCT/US2004/027508; 19 pages, Feb. 16, 2005.

Office Action from U.S. Appl. No. 90/008,461 (formerly U.S. Patent 7,080,598) (15 pages), Mailed Nov. 19, 2007.

Office Action from U.S. Appl. No. 90/008,453 (formerly U.S. Patent 7,051,661) (12 pages), Mailed Nov. 19, 2007.

Del Vecchio et al. "Center Flow Covered Hoppers" in Trains; vol. 60, Issues 2, pp. 42-47 retrieved online Nov. 13, 2007, from Research Library Database (Document ID 47751012), http://proquest.umi.com/pqdweb?did=47751012&sid=1&Fmt=4&clientId=19649&RQT=309&VName=PQD, Feb. 2000.
Chinese Office Action Application No. 2004800246063, 7 pages, Nov. 2, 2007.
Office Action for Chinese Patent Application No. 200480024605.9 (w/English translation), 8 pages, Feb. 1, 2008.
Chinese Office Action, Application No. 200480024605.9, 4 pages, Jul. 18, 2008.
Russian PTO Letter of Inquiry with English translation, 9 pages, Jan. 24, 2008.
Chinese Office Action (w/translation), Application No. 200480024605.9, 8 pages.
Chinese Office Action; Application No. 200480024606.3 (w/english translation), pp. 14, May 15, 2009.
Australian Office Action; Application No. 2004268995; pp. 2, Sep. 14, 2009.
Australian Office Action; Application No. 2004268992; pp. 15, Sep. 22, 2009.

* cited by examiner

RAILCAR WITH DISCHARGE CONTROL SYSTEM

RELATED APPLICATION

This application is a continuation of U.S. application Ser. No. 10/926,370 entitled "Railcar with Discharge Control System" filed Aug. 25, 2004, now U.S. Pat. No. 7,051,661 which claims the benefit of U.S. Provisional Patent Application Ser. No. 60/498,117 entitled "Railcar With Discharge Control System," filed Aug. 26, 2003, the contents of which are incorporated herein by reference in their entirety.

TECHNICAL FIELD

The present invention is related in general to railcars and more particularly to railcars which discharge cargo or lading, such as coal, ore, ballast, grain and any other lading suitable for transportation in railcars.

BACKGROUND OF THE INVENTION

Railway hopper cars with one or more hoppers have been used for many years to transport and sometimes store dry, bulk materials. Hopper cars are frequently used to transport coal, sand, metal ores, ballast, aggregates, grain and any other type of lading which may be satisfactorily discharged through respective openings formed in one or more hoppers. Respective discharge openings are typically provided at or near the bottom of each hopper to rapidly discharge cargo. A variety of door assemblies and gate assemblies along with various operating mechanisms have been used to open and close discharge openings associated with railway hopper cars.

Hopper cars may be classified as open or closed. Hopper cars may have relatively short sidewalls and end walls or relatively tall or high sidewalls and end walls. The sidewalls and end walls of many hopper cars are typically reinforced with a plurality of vertical side stakes. The sidewalls and end walls are typically formed from steel or aluminum sheets. Some hopper cars include interior frame structures or braces to provide additional support for the sidewalls.

Applicable standards of the Association of American Railroads (AAR) established maximum total weight on rail for any railcar including box cars, freight cars, hopper cars, gondola cars, and temperature controlled cars within prescribed limits of length, width, height, etc. All railway cars operating on commercial rail lines in the U.S. must have exterior dimensions which satisfy associated AAR clearance plates. Therefore, the maximum load which may be carried by any railcar is typically limited by the applicable AAR clearance plate and empty weight of the railcar. Reducing the empty weight of a railcar or increasing the interior dimensions may increase both volumetric capacity and maximum load capacity of a railcar while still meeting applicable AAR standards for total weight on rail and clearance plate.

Prior systems for opening and closing gates on hopper cars often include additional linkages that operated in co-planes and in perpendicular planes that required greater operating forces and greater complexity. Some prior art systems include torque tubes and other types of tension members.

SUMMARY OF THE INVENTION

In accordance with teachings of the present invention, several disadvantages and problems associated with railway cars having discharge control systems have been substantially reduced or eliminated. One embodiment of the present invention includes a hopper car having at least one hopper and one discharge opening formed adjacent to the bottom or a lower portion of the hopper. A discharge control system incorporating teachings of the present invention may be used to open and close a respective door assembly or gate disposed adjacent to each discharge opening.

One aspect of the present invention includes a discharge control system which may be mounted on various types of railway cars to control discharge of lading when the railway car is stationary at a discharge facility or when the railway car is moving relative to a discharge facility. The discharge control system may be satisfactorily used with hopper cars having longitudinal discharge openings and associated gate or door assemblies.

Technical benefits of the present inventions include substantially reducing the empty car weight of a railway car while often increasing load carrying capability, reducing maintenance requirements and increasing service life of the railway car. For one application the empty car weight of a coal hopper car formed in accordance with teachings of the present invention was reduced by approximately twenty four hundred pounds (2400 lbs.) as compared with a prior coal hopper with the same applicable AAR clearance plate and AAR specifications.

A discharge control system incorporating teachings of the present invention may be used to operate doors or gates hinged to a center sill or other centrally located structure of a railway car, highway truck or other equipment having at least one hopper. The discharge control system simplifies synchronization of multiple gates, keeps components of the discharge control system out of the commodity during loading, transport and discharge to minimize contamination. A common air cylinder or similar actuator oriented longitudinally may be used to move a common linkage running along a longitudinal axis and below the center sill of the railcar. The discharge control system eliminates torque tubes and other relatively expensive techniques that have been previously used to synchronize opening and closing of doors and gates. The discharge control system often provides greatest mechanical advantage when respective door linkages are approximately perpendicular to a common longitudinal linkage and the gates are moving to their closed position. The discharge control system has fewer pivot points and linkages and no torsion members, incorporates over center locking and simplified adjustment as compared with many prior operating assemblies for discharge doors.

Further technical benefits of the present invention include relatively easy adjustments which may be made to an air cylinder or similar actuator to limit opening of the longitudinal doors to control the rate of discharging lading. Adjustments may also be made to a primary linkage and/or secondary linkages to control opening of respective longitudinal doors and the rate of discharging lading.

For one embodiment a variable choke or variable control valve may be attached to an air cylinder to control the rate of opening or closing of longitudinal doors. Also, one or more mechanical stops may be included as part of the air cylinder to allow limiting the opening of the associated longitudinal doors. For some applications quick opening rapid discharge of lading from a hopper car may be preferred. For other applications relatively slow, partial opening of longitudinal doors may be preferred for other types of lading.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Figure 1:
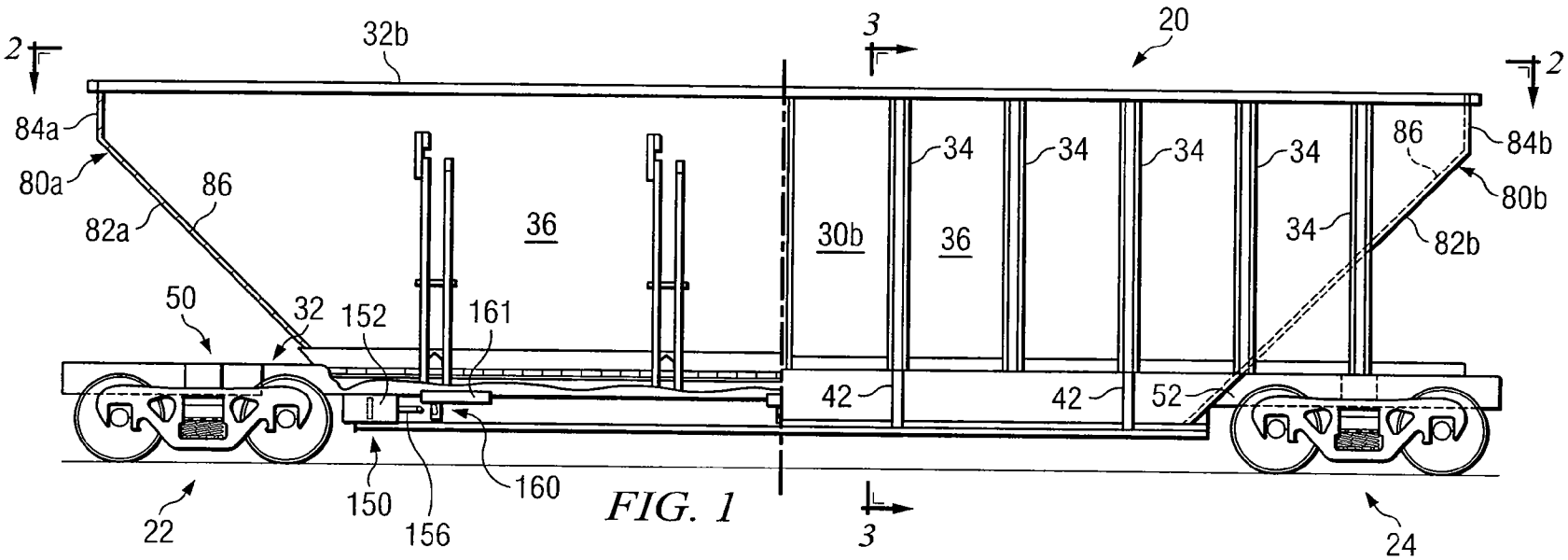
FIG. 1 is a schematic drawing in elevation with portions broken away showing a side view of a railway car incorporating teachings of the present invention.

Preferred embodiments of the invention and its advantages are best understood by referring to FIGS. 1-16C of the drawings. Like numbers may be used for like and corresponding parts of the various drawings.

Various features of the present invention will be described with respect to hopper car 20 which may be satisfactorily used to carry coal and other types of lading. Typical dimensions for one embodiment of hopper car 20 incorporating teachings of the present invention may include length between truck centers of forty (40) feet six (6) inches; a length over strikers of fifty (50) feet two and one half (2½) inches; and a length over pulling faces of fifty-three (53) feet and one (1) inch. Hopper car 20 may be satisfactorily used to carry bulk materials such as coal and other types of lading. Examples of additional lading include, but are not limited to, sand, grain, metal ores, aggregate and ballast.

Hopper car 20 may be generally described as an open hopper car with bottom discharge openings or outlets. Respective door assemblies or gates may be opened and closed to control discharge of lading from the discharge openings or outlets of hopper car 20. However, the present invention is not limited to open hopper cars or hopper cars that carry coal. For example various features of the present invention may be satisfactorily used with gondola cars, closed hopper cars, articulate hopper cars, hopper cars that carry grain or any other type of hopper car and ballast car. Examples of lading carried by such hopper cars may include, but are not limited to, corn distillers dried grains (DDG), corn condensed distillers solubles (CDS), corn distillers dried grains/solubles (DDGS) and wet distillers grain with solubles (WDGS). Such products are frequently associated with ethanol production from corn and/or other types of grain.

Teachings of the present invention may be satisfactorily used with other types of railway cars having a wide variety of interior supporting structures. The present invention is not limited to hopper cars having interior cross brace assemblies or hopper cars having longitudinal discharge openings.

Hopper car 20 incorporating teachings of the present invention may include a pair of sidewall assemblies 30*a*, 30*b*, bottom slope sheet assemblies 40*a* and 40*b* and sloped end wall assemblies 80*a* and 80*b* mounted on railway car underframe 50. For embodiments of the present invention as shown in FIGS. 1-16C, hopper car 20 may be generally described as having a single, open hopper defined in part by sidewall assemblies 30*a*, 30*b*, bottom slope sheet assemblies 40*a* and 40*b* and end wall assemblies 80*a* and 80*b* mounted on railway car underframe 50. Other railcars formed in accordance with teachings of the present invention may include two or more hoppers.

Figure 2:
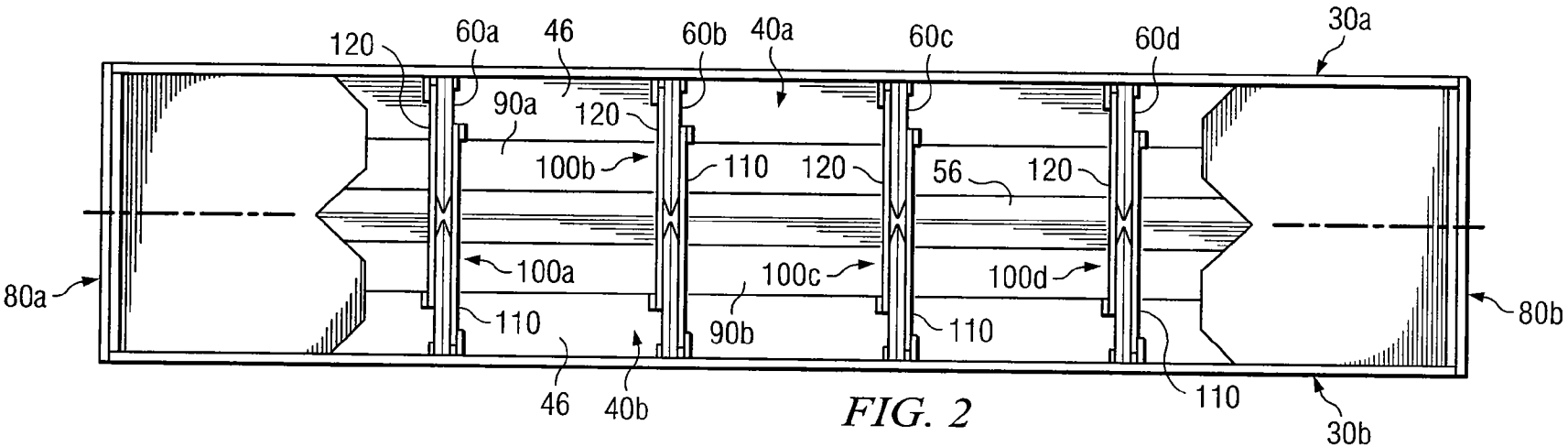
FIG. 2 is a schematic drawing showing a plan view with portions broken away of taken along lines 2-2 of FIG. 1.

Railway car underframe 50 includes center sill 52 and side sills 54*a* and 54*b*. See FIGS. 3, 4 and 9-11. Side sills 54*a* and 54*b* extend generally parallel with center sill 52 and are spaced laterally from opposite sides of center sill 52. In some embodiments, a plurality of cross bearers 60 may be mounted on center sill 52. For embodiments of the present invention as shown in FIGS. 1 and 2, hopper car 20 may include four (40) cross bearers 60. Side sills 54*a* and 54*b* may be attached to opposite ends of cross bearers 60. For the purposes of describing various features of the present invention, cross bearers 60 have been designated 60A, 60B, 60C and 60D.

For some applications a railcar may be formed in accordance with the teachings of the present invention with any number of cross bearers. The present invention is not limited to railcars having cross bearers. Also, the configuration and design of cross bearers associated with a railcar incorporating teachings of the present invention may be substantially modified as compared with cross bearers 60.

A pair of railway trucks 22 and 24 may be attached proximate opposite ends of center sill 52. For embodiments of the present invention as represented by hopper car 20, center sill 52 may have a generally rectangular cross-section with a generally triangular-shaped dome or cover 56 disposed thereon. The present invention may be used with center sills having a wide variety of configurations and designs other than a rectangular cross section. The present invention may be used with center sills that do not have domes or covers. The present invention is not limited to center sill 52 or cover 56.

Sidewall assemblies 30*a* and 30*b* may have approximately the same overall configuration and dimensions. Therefore, only sidewall assembly 30*b* will be described in detail. Sidewall assembly 30*b* preferably includes top cord 32*b* with a plurality of side stakes 34 extending between top cord 32*b* and side sill 54*b*. Side stakes 34 may also be spaced longitudinally from each other along the length of top cord 32*b* and side sill 54*b*. A plurality of metal sheets 36 may be securely attached with interior portions of top cord 32*b*, side stakes 34 and side sill 54*b*. In a similar manner, sidewall assembly 30*a* preferably includes top cord 32*a*, side stakes 34 and metal sheets 36.

For purposes of describing various features associated with the present invention metal sheets 36 which form the interior surface of sidewall assembly 30*a* have been designated 36*a*. In a similar manner metal sheets 36 which form the interior surface of sidewall assembly 30*b* have been designated as 36*b*. See FIGS. 3 and 5.

Bottom slope sheet assemblies 40*a* and 40*b* may have approximately the same overall dimensions and configuration. Therefore, only bottom slope sheet assembly 40*b* will be described in more detail. Bottom slope sheet assembly 40*b* preferably includes a plurality of angles 42 extending inwardly from side sill 54*b* to bottom cord 44*b*. Bottom cord 44*b* and top cord 32*b* may be formed from hollow metal tubes having a generally rectangular configuration. A plurality of metal sheets 46 may be attached with interior surfaces of respective angles 42 and bottom cord 44*b*. Metal sheets 36 and 46 may have similar specifications and thickness.

For some applications, an additional angle 48*b* may be attached to bottom cord 44*b* opposite from angles 42 to provide additional structural strength for hopper car 20. Bottom cord 44*b* and angle 48*b* preferably extend along substantially the full length of hopper car 20. In a similar manner, bottom slope sheet assembly 40*a* preferably includes angles 42, metal sheets 46, bottom cord 44*a* and an additional angle 48*a*.

Bottom slope sheet assemblies 40*a* and 40*b* may be attached with respective side sills 54*a* and 54*b*. Slope sheet assemblies 40*a* and 40*b* preferably extend inward at an angle from respective side sills 54*a* and 54*b* to a location proximate bottom clearance or minimum clearance for hopper car 20 relative to associated railway tracks (not expressly shown). For embodiments of the present invention represented by hopper car 20 slope sheet assemblies 40*a* and 40*b* may extend at an angle of approximately forty five degrees (45°) relative to respective sidewall assemblies 30*a* and 30*b*.

Portions of bottom slope sheet assembly 40*a* cooperate with adjacent portions of center sill 52 and dome 56 to define longitudinal discharge openings 26*a*. In a similar manner portions of bottom slope sheet assembly 40*b* cooperate with adjacent portions of center sill 52 and dome 56 to define in part longitudinal discharge openings 26*b*. See FIGS. 4 and 11. Longitudinal discharge openings 26*a* and 26*b* are preferably disposed along opposite sides of center sill 52. For some applications a hopper car may be formed in accordance with teachings of the present invention with more than one hopper and more than two longitudinal discharge openings. The present invention is not limited to hopper cars with only two longitudinal discharge openings.

A plurality of longitudinal door assemblies 90*a* and 90*b* are preferably hinged proximate the upper portion of center sill 52 adjacent to dome assembly 56. Longitudinal door assemblies 90*a* and 90*b* may also be described as "swinging longitudinal slope sheets." Longitudinal door assemblies 90*a* and 90*b* may be formed with overall dimensions and configurations similar to bottom slope sheet assemblies 40*a* and 40*b*. Attaching longitudinal door assemblies 90*a* and 90*b* proximate the upper portion of center sill 52 in accordance with teachings of the present invention may increase the volume of lading which is carried within hopper car 20 and may also reduce the center of gravity when hopper car 20 is loaded.

Various types of mechanical hinges may be satisfactorily used to respectively engage door assemblies 90 with dome assembly 56 proximate the upper portion of center sill 52. For embodiments of the present invention as shown in FIGS. 3, 4 and 9-11, piano type hinges 92 may be used to rotatably attach or pivotally attach door assemblies 90 proximate upper portions of center sill 52.

Alternatively, hinge assemblies 92 may include any suitable hinge, such as spring, continuous, butt, slip apart, and weld-on hinges, to allow door assemblies 90 to move between an open and closed position. For example, hinge assemblies 92 preferably includes flat plate butt hinges that are bolted between door assemblies 90 and an upper portion of center sill 52 to pivotally move door assemblies 90 between an open and closed position.

For purposes of describing various features of the present invention door assemblies 90 have been designated as 90*a* and 90*b*. Hinge assemblies 72 have been designated as 92*a* and 92*b*.

Figure 5:
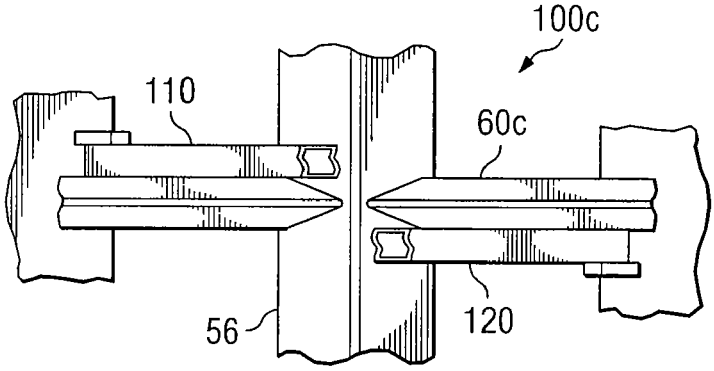
FIG. 5 is a schematic drawing in section taken along lines 5-5 of FIG. 4 with portions broken away showing a plan view of an interior supporting structure.
Figure 6:
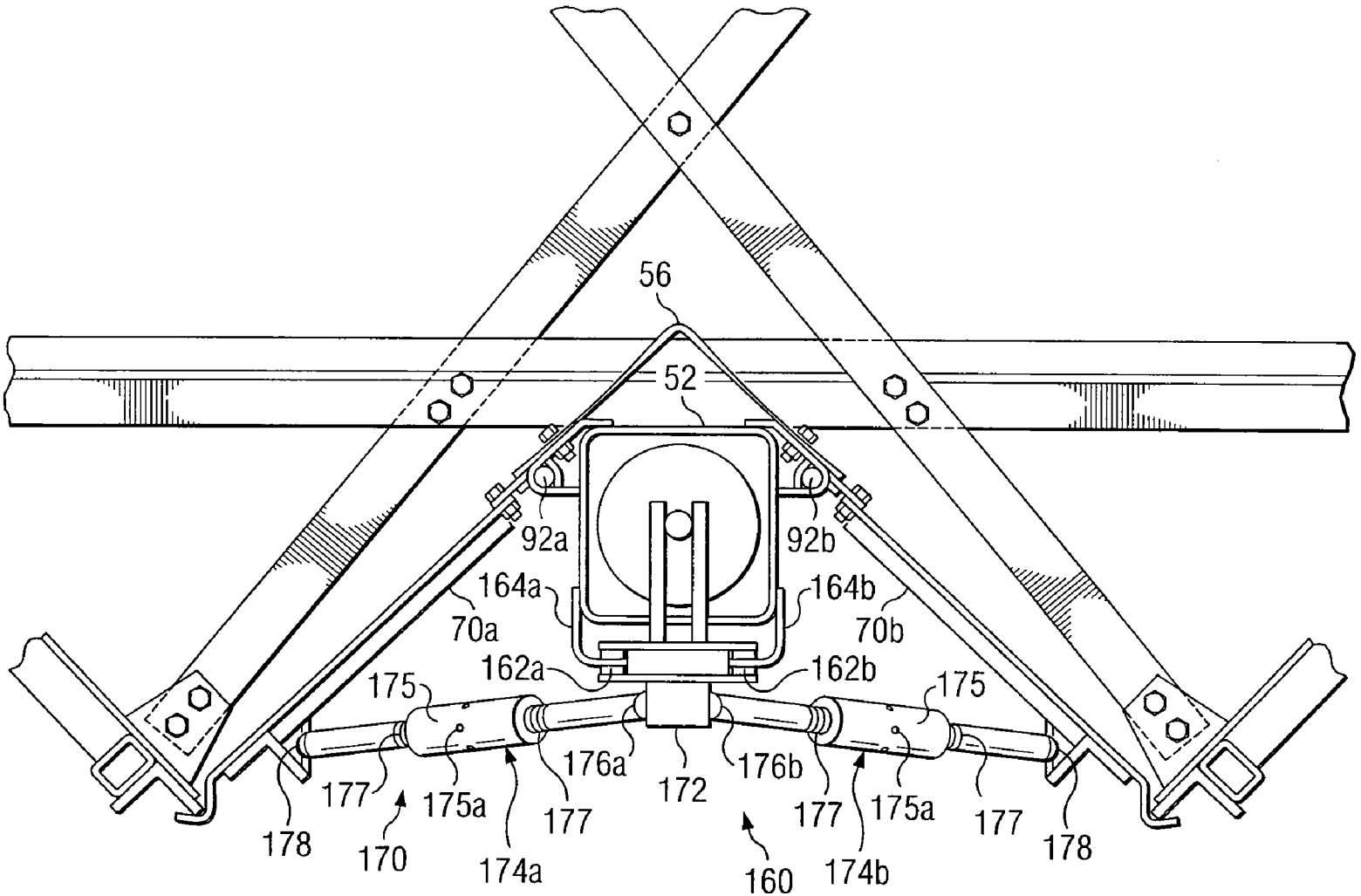
FIG. 6 is an enlarged schematic drawing in section with portions broken away showing one example of a discharge control system incorporating teachings of the present invention satisfactory for moving door assemblies between their first, closed position and their second, open position.
Figure 7:
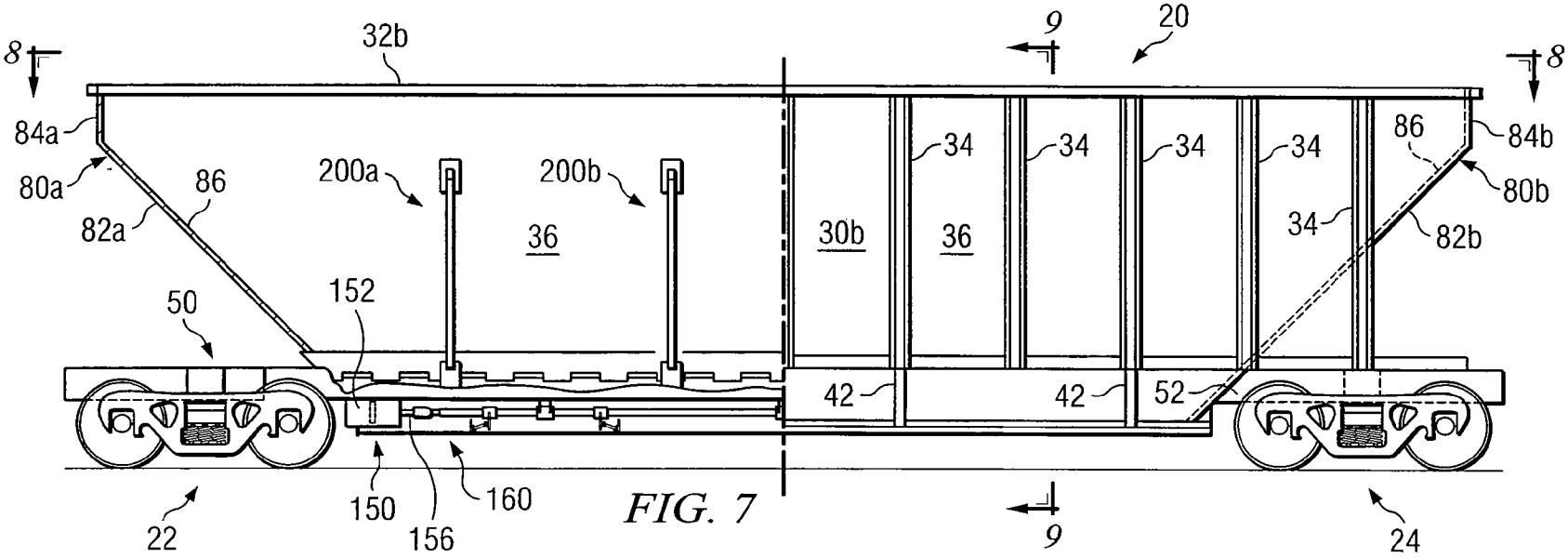
FIG. 7 is a schematic drawing in elevation with portions broken away showing a side view of a hopper car incorporating teachings of the present invention.
Figure 11:
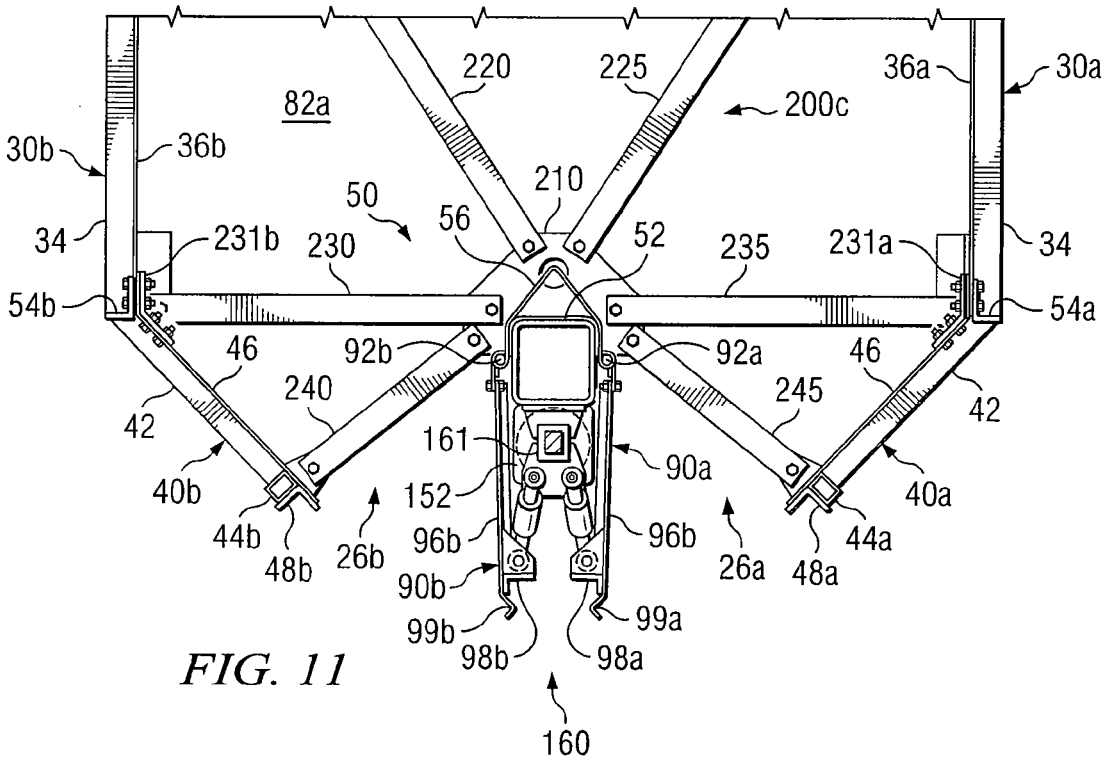
FIG. 11 is a schematic drawing in section with portions broken away showing the longitudinal discharge openings and respective door assemblies of FIG. 9 in their second, open position.
Figure 12C:
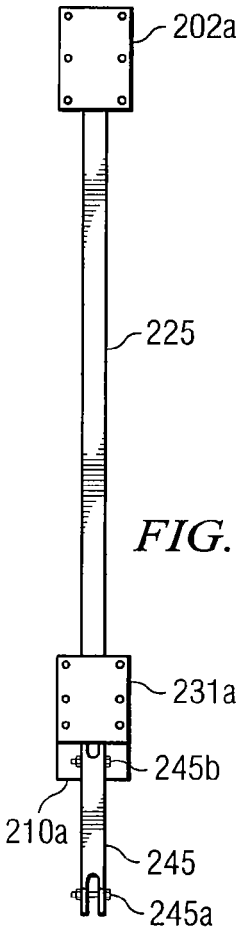
FIG. 12C is a schematic drawing showing a side view of the interior supporting structure of FIG. 12A.
Figure 12D:
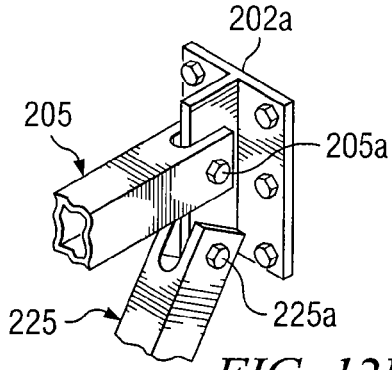
FIG. 12D is a schematic drawing showing an isometric view with portion broken away of the interior supporting structure of FIG. 12A.
Figure 12A:
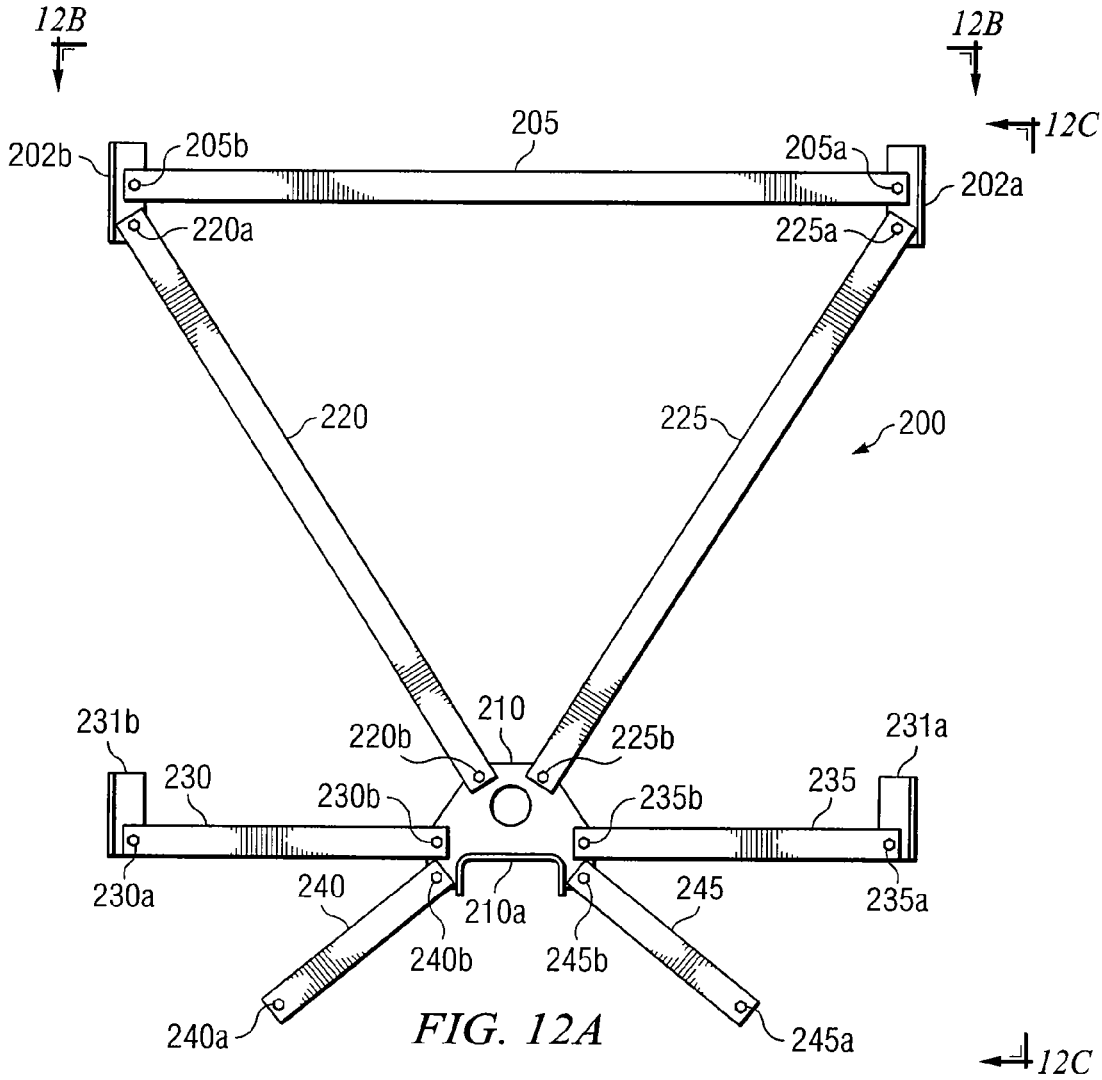
FIG. 12A is a schematic drawing in elevation showing an interior supporting structure incorporating teachings of the present invention.
Figure 12B:
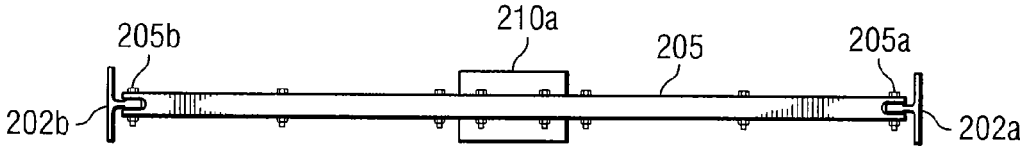
FIG. 12B is a schematic drawing showing a plan view of the interior supporting structure of FIG. 12A.

Each door assembly 90*a* and 90*b* preferably includes a first, closed position which prevents the discharge of lading from hopper car 20 (see FIGS. 3 and 9) and a second, open position which allows lading to be discharged from hopper car 20 (see FIGS. 5 and 11). For some applications longitudinal door assemblies 90*a* and 90*b* may be directly attached to or directly coupled with the upper portion of center sill 52. For some applications the length of longitudinal openings 26*a* and 26*b* and door assemblies 90*a* and 90*b* may be approximately twenty-nine (29) feet.

Door assemblies 90 formed in accordance with teachings of the present invention may extend along approximately the full length of respective longitudinal discharge openings 26*a* and 26*b*. The overall empty car weight of hopper car 20 may be reduced as compared to prior hopper cars. As such, the cost associated with manufacture and maintenance of hopper car 20 may also be reduced. Door assembly 90 may be formed using metal plates 96*a* and 96*b* having similar thickness and other characteristics associated with metal plates 36 and 46. Respective angles 98*a* and 98*b* may be attached with the longitudinal edge of each door assembly 98*a* and 98*b* opposite from respective hinges 92*a* and 92*b*. For some application angles 98*a* and 98*b* may be replaced by an I-beam, a Z-beam or any other suitable structural shape.

Figure 4:
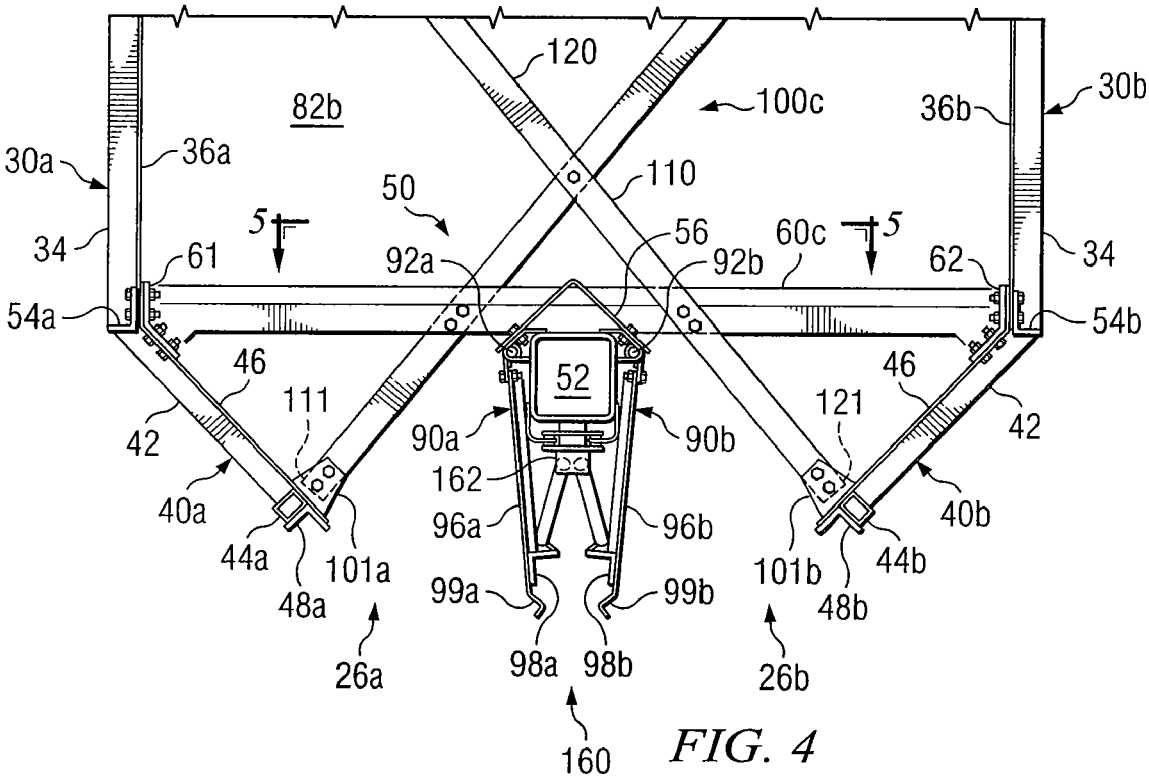
FIG. 4 is a schematic drawing in section with portions broken away showing portions of the discharge control system of FIG. 3 with the door assemblies in their second, opened position.

As shown in FIGS. 4 and 11, respective longitudinal recesses 99*a* and 99*b* may be formed along an edge of each door assembly 90*a* and 90*b* opposite from respective hinges 92*a* and 92*b*. The overall dimensions and configuration of recesses 99*a* and 99*b* may be selected to be compatible with the dimensions and configuration of respective angles 48*a* and 48*b*. In some embodiments, outer edge of recesses 99*a* and 99*b* may extend around angles 48*a* and 48*b* when door assembly 90*a* and 90*b* are moved to a closed position.

Figure 3:
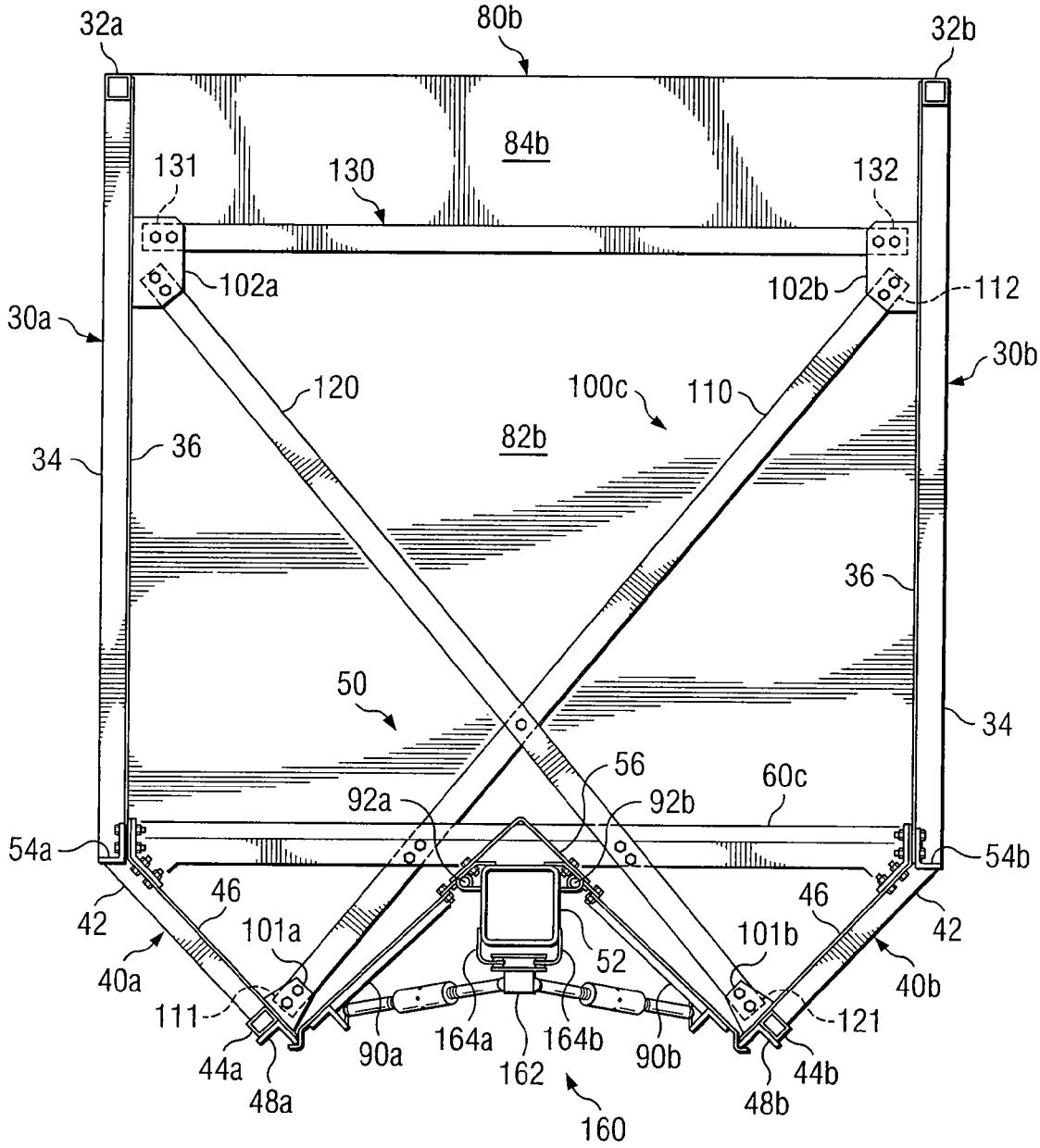
FIG. 3 is a schematic drawing in section with portions broken away taken long lines 3-3 of FIG. 1 showing portions of a discharge control system incorporating teachings of the present invention with a pair of door assemblies in their first, closed position.
Figure 9:
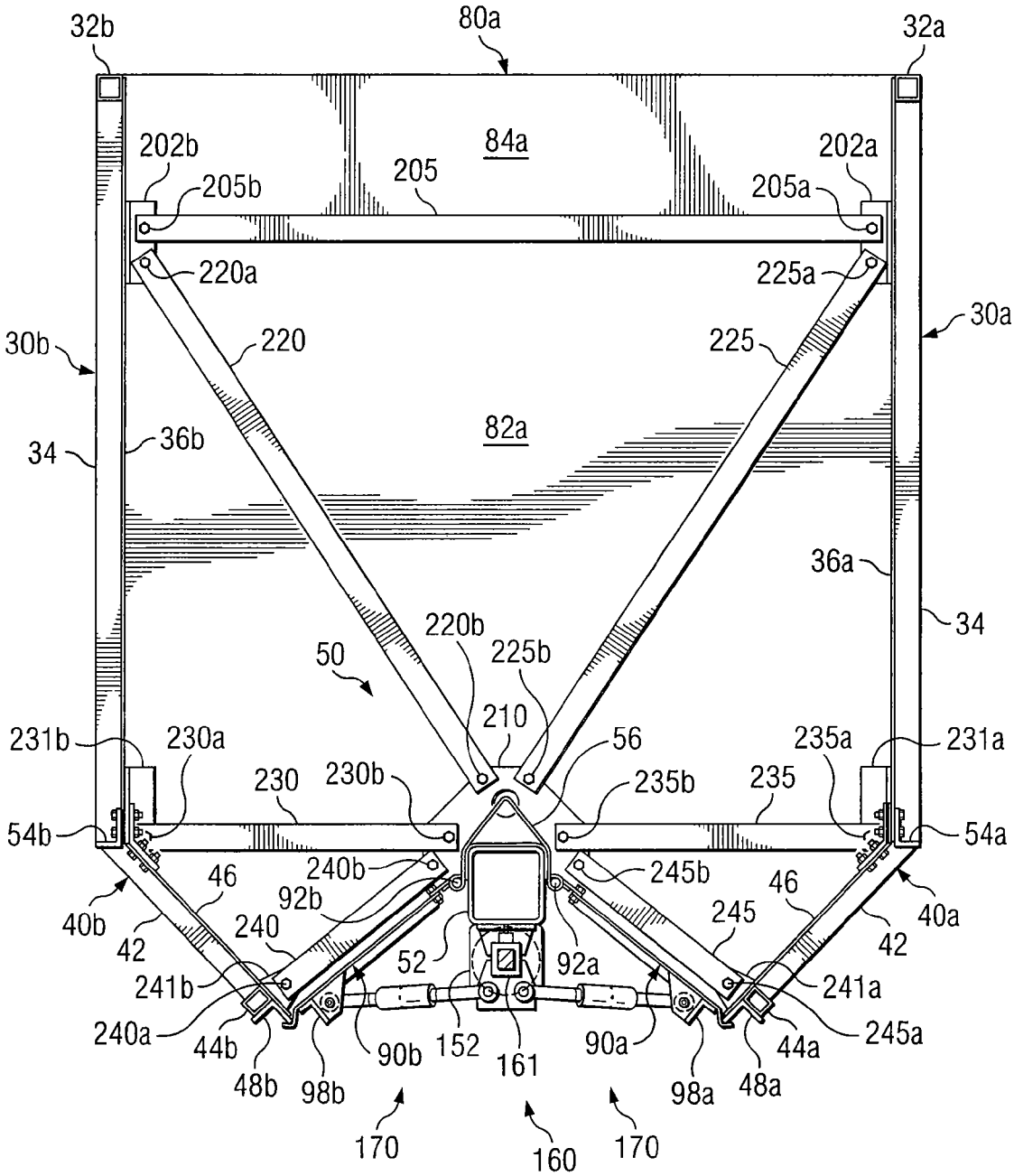
FIG. 9 is a schematic drawing in section with portions broken away taken long lines 9-9 of FIG. 7 showing another example of an interior supporting structure, longitudinal discharge openings and respective door assemblies in their first, closed position.
Figure 10:
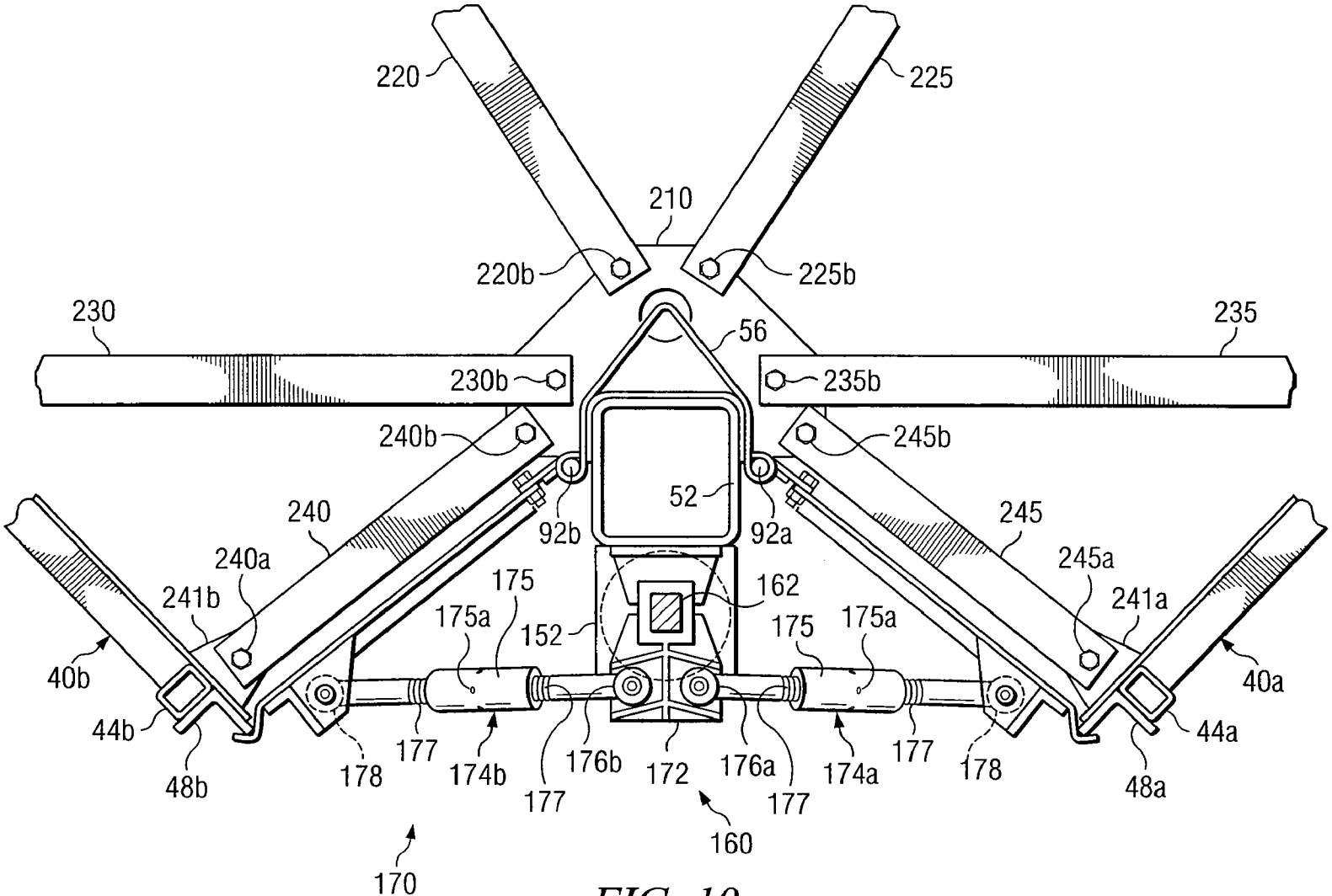
FIG. 10 is an enlarged schematic drawing in section with portions broken away showing another example of an interior supporting structure, longitudinal discharge openings and respective door assemblies in their first, closed position.

As shown in FIGS. 3, 9 and 10 recesses 99*a* and 99*b* cooperate with respective angles 48*a* and 48*b* to help seal respective longitudinal discharge openings 26*a* and 26*b* to eliminate or substantially minimize any leakage of lading from hopper car 20. Various types of sealing mechanisms may be satisfactorily used to engage a door assembly with adjacent portions of a bottom slope sheet assembly in accordance with teaching of the present invention. The present invention is not limited to use with recesses 99 and angles 48.

End wall assemblies 80*a* and 80*b* may have approximately the same overall configuration and dimensions. Therefore, only end wall assembly 80*a* will be described in detail. For some applications end wall assembly 80*a* may include sloped portion 82*a* and a generally vertical portion 84*a*. End wall assembly 80*a* may be formed from one or more metal sheets 86. Metal sheets 86 may have similar thickness and other characteristics associated with metal sheets 36 and 46.

A plurality of interior supporting structures or interior cross brace assemblies 100 and 200 may be disposed within hopper car 20 extending between sidewall assemblies 30*a* and 30*b* and bottom slope sheet assemblies 40*a* and 40*b*. The various components associated with interior supporting structures 100 and 200 cooperate with each other to provide adequate strength and load carrying capabilities for bottom slope sheet assemblies 40*a* and 40*b* while at the same time providing relatively large longitudinal discharge openings 26*a* and 26*b* adjacent to center sill 52.

Interior supporting structures are typically formed from structural members such as plates, angles, bars, channels, beams, tubing, cables, ropes, wires, a combination of different structures, or any other structural member.

Referring to FIGS. 1 through 6, for purposes of describing various features of the present invention interior cross brace assemblies 100 have been designated 100*a*, 100*b*, 100*c* and 100*d*. For other applications, more or fewer interior brace assemblies formed in accordance with teachings of the present invention may be disposed within a railcar incorporating teachings of the present invention.

For embodiments of the present invention as shown in FIGS. 1-6 interior cross brace assemblies 100*a*, 100*b*, 100*c* and 100*d* may have substantially the same configuration and dimensions. Therefore, various features of the invention will be described with respect to interior cross brace assembly 100*c*. For some applications, the dimensions and/or configuration of interior brace assemblies disposed within a hopper car may be varied in accordance with teachings of the present invention. For example one or more cross brace assemblies may be formed with larger or smaller components as compared with other cross brace assemblies associated with the hopper car.

Hopper cars may be formed with fewer than four cross brace assembly 100 but may also be formed with more than five cross brace assembly 100. In some embodiments of the present invention, hopper car 20 is formed with three cross brace assembly 100. Also, partitions (not expressly shown) may be used in place of interior cross brace assemblies.

Respective diagonal braces 110 and 120 preferably extend between sidewall assemblies 30*a* and 30*b* and bottom slope sheet assemblies 40*a* and 40*b* for each interior cross brace assembly 100*a*, 100*b*, 100*c* and 100*d*. For the embodiment of the present invention represented by interior brace assembly 100*c* as shown in FIG. 3, first end 111 of diagonal brace 110 may be secured proximate bottom cord 44*a* and angle 48*a* of bottom slope sheet assembly 40*a* by connector 101*a*. Second end 112 of diagonal brace 110 may be secured with sidewall assembly 30*b* by connector 102*b*. In a similar manner first end 121 of diagonal brace 120 may be secured proximate bottom cord 44*b* and angle 48*b* of bottom slope sheet assembly 40*b* by connector 101*b*. Second end 122 of diagonal brace 120 may be secured to sidewall assembly 30*a* by connector 102*a*.

As shown in FIG. 5 diagonal brace 110 may be coupled with one side of cross bearer 60*c*. Diagonal brace 120 may be coupled with the opposite side of cross bearer 60*c*. For some applications cross bearer 60*c* may include a generally triangular-shaped configuration to accommodate discharge of lading from the car plane.

Horizontal crosspiece or brace 130 preferably extends between sidewall assemblies 30*a* and 30*b*. First end 131 of horizontal crosspiece or brace 130 may be engaged with connector 102*a*. Second end 132 of horizontal brace 130 may be securely engaged with connector 102*b*. Connectors 102*a* and 102*b* are preferably mounted on interior surfaces of sidewall assemblies 30*a* and 30*b* spaced from top chords 32*a* and 32*b* at locations generally aligned with respective horizontal cross bearers 60*a*, 60*b*, 60*c* and 60*d*. The vertical location of each horizontal brace 130 relative to center sill 52 may correspond approximately with the intersection of end wall portions 82*a* and 84*a* and/or end wall portions 82*b* and 84*b*.

FIGS. 7-12D show another example of an interior supporting structure or interior brace assembly 200 which may be disposed within hopper car 20 extending between sidewall assemblies 30*a* and 30*b* and bottom slope sheet assemblies 40*a* and 40*b*. Various components associated with interior supporting structure 200 cooperate with each other to provide adequate strength and load carrying capabilities for bottom slope sheet assemblies 40*a* and 40*b* while at the same time providing relatively large longitudinal discharge openings 26*a* and 26*b* adjacent to center sill 52.

For embodiments of the present invention as shown in FIGS. 7-12D interior cross brace assemblies 200*a*, 200*b*, 200*c* and 200*d* may have substantially the same configuration and dimensions. Therefore, various features of the invention will be described with respect to interior cross brace assembly 200*c*. For some applications, the dimensions and/or configuration of interior brace assemblies disposed within a hopper car may be varied in accordance with teachings of the present invention.

For example one or more cross brace assemblies may be formed with larger or smaller components as compared with other cross brace assemblies associated with the hopper car. In some embodiments, cross brace assembly 100 are formed of different sized members or components. For example, in one embodiment, cross brace assembly 100 includes a reduced cross-section member such as a cable (shown below in more detail) to form a brace component.

Hopper cars may be formed with fewer than four cross brace assembly 200 but may also be formed with more than five cross brace assembly 200. In some embodiments of the present invention, hopper car 20 is formed with three cross brace assembly 200. In yet other embodiments, hopper car 20 is formed with brace assembly 100, brace assembly 200 or any combination thereof. Also, partitions (not expressly shown) may be used in place of interior cross brace assemblies.

Interior brace assembly 200 may sometimes be referred to as a "rib plate assembly". Interior cross brace assembly 200*c* preferably includes rib plate 210 centered over and coupled to center sill 52 at bracket 210*a*.

Rib plate 210 may be securely mounted on and attached with center sill 52. A generally U-shaped bracket 210*a* may be formed as an integral component of rib plate 210. Bracket 210*a* preferably includes dimensions compatible with the upper portion of center sill 52.

Various types of mechanical fasteners such as bolts and huck fasteners and/or welding techniques may be satisfactorily used to securely engage bracket 110*a* with center sill 52.

Each interior brace assembly 200 preferably includes respective horizontal cross bearers 230 and 235 extending from respective side sills 54*a* and 54*b* and connecting to rib plate 210. Typically, horizontal cross bearers 230 and 235 are preferably attached to and extend generally laterally from rib plate 210. Various types of mechanical fasteners such as bolts and huck fasteners and/or welding techniques may be satisfactorily used to securely attach interior brace assembly 200. For example, horizontal cross bearer 230 may bolt to respective side sill 54*b* using plate member 231*b* at first end 230*a* and second end 230*b* of cross bearer 230 couples with rib plate 210. Similarly, cross bearer 235 may connect to respective side sill 54*a* using plate member 231*a* at first end 235*a* and second end 235*b* of cross bearer 235 couples with rib plate 210.

Figure 8:
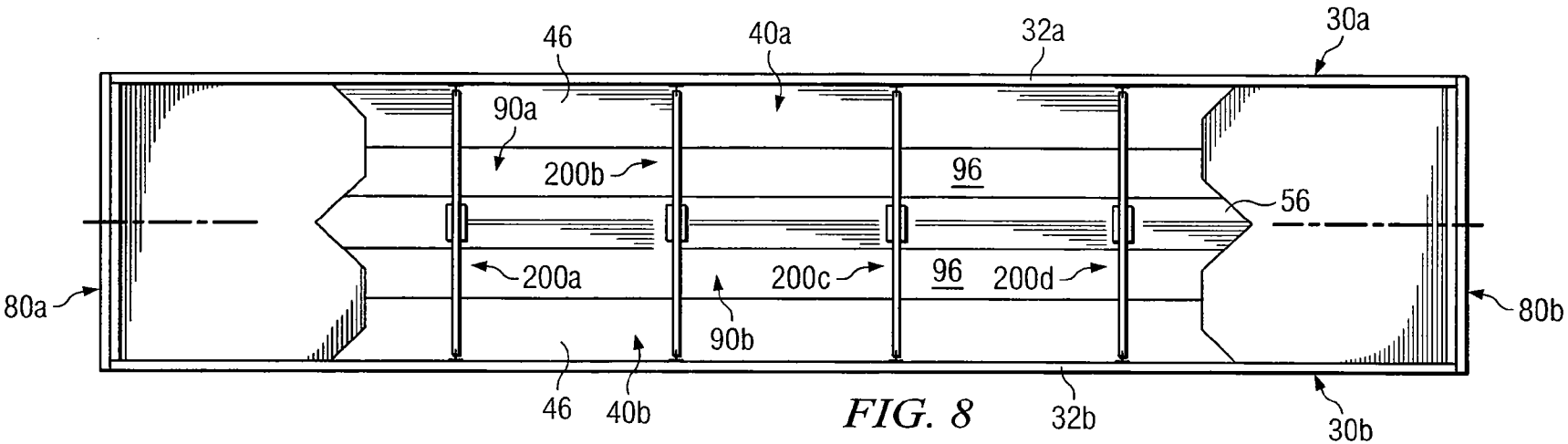
FIG. 8 is a schematic drawing showing a plan view with portions broken away of taken along lines 8-8 of FIG. 7.

Upper diagonal braces 220 and 225 preferably extend between sidewall assemblies 30*a* and 30*b* and rib plate 210. For the embodiment of the present invention as shown in FIG. 8, first end 220*a* of upper diagonal brace 220 may be secured proximate sidewall assembly 30*b* at connector plate 202*b* and extend diagonally to connect with rib plate 210 at second end 220*b*. Similarly, first end 225*a* of upper diagonal brace 225 may be secured proximate sidewall assembly 30*a* by connector plate 202*a* and extend diagonally to connect with rib plate 210 at second end 225*a*.

Lower diagonal braces 240 and 245 preferably extend between bottom slope sheet assemblies 40*a* and 40*b* and rib plate 210. First end 240*a* of lower diagonal brace 240 preferably couples to bottom cord 44*b* and angle 48*b* of bottom slope sheet assembly 40*b* being secured by connector plate 241*b*. Second end 240*b* of lower diagonal brace 240 may be secured with rib plate 210. In a similar manner first end 245*a* of lower diagonal brace 245 may be connected with bottom cord 44*a* and angle 48*a* of sloped sheet assembly 40*a* by connector plate 241*a*. Second end 245*b* of lower diagonal brace 245 may be secured with rib plate 210.

Horizontal crosspiece 205 preferably extends between sidewall assemblies 30*a* and 30*b*. First end 205*a* of horizontal crosspiece 205 may be engaged with connector 202*a*. Second end 205*b* of horizontal crosspiece 205 may be securely engaged with connector plate 202*b*. Pairs of connector plates 202*a* and 202*b* are preferably mounted on interior surfaces of sidewall assemblies 30*a* and 30*b* at locations generally aligned with respective horizontal cross bearers 230 and 235.

In some alternate embodiments of the interior supporting structure 200, cross brace assembly 200 may include a reduced cross section member (not expressly shown). For example, cables such as aircraft quality stainless steel cable may replace one or more braces such as lower diagonal braces 240 and 245. By reducing the cross section of certain interior members, hopper car 20 may rapidly discharge lading.

Various types of operating assemblies and door closing mechanisms may be satisfactorily used to open and close longitudinal door assemblies or gates 90*a* and 90*b*. For the embodiments shown in FIGS. 1-16C discharge control system 160 may include operating assembly or opening and closing assembly 150 along with door connector assembly 170.

Discharge control system 160 incorporating teachings of the present invention generally has pivot points and linkages and no torsion members, incorporates over center locking, and simplified adjustment. Discharge control system 160 incorporating teachings of the present system may operate gates or doors 90*a* and 90*b* by pushing or pulling with air cylinder 152, hydraulic cylinder or other type of actuator via a common linkage such as clevis 180 centered under center sill 52 of railcar 20 or highway truck (not expressly shown) longitudinally. The common linkage or clevis 180 may be attached to secondary linkages such as bar 162 and arms 174*a* and 174*b* that connect to door assemblies 70 or gates 90*a* and 90*b* on both sides that are swung up or down depending on the direction of the common linkage.

Gates 90*a* and 90*b* may be hinged proximate center sill 52 or other centrally located structure with hinges 92*a* and 92*b* oriented longitudinally and above the common linkage. Each secondary linkage such as arm 174*a* and 174*b* provides the lower horizontal leg of a triangular shaped mechanism consisting of gate 90*a* and 90*b* as the hypotenuse and the common linkage such as bar 162 and centrally located structure or center sill 52 as the upright leg in a closed position. The secondary linkages such as arms 174*a* and 174*b* may be pushed or pulled past center to provide a positive lock on gates 90*a* and 90*b*, commonly known as over center locking. The secondary linkages may be symmetrical to each other and provide an equilibrium of the transverse forces both while operating and in a locked position.

Only relatively simple adjustments are required such as lengthening or shortening secondary linkages such as arms 174*a* and 174*b* until respective gates 90*a* and 90*b* are closed with sufficient preload. An over center lock is adjusted by a stop (not expressly shown) at the end of the common linkage such as bar 162 which can be adjusted longitudinally to increase or decrease the desired travel of the common linkage. The secondary linkages or arms 174*a* and 174*b* rotate into a compound angle mainly oriented in the longitudinal direction parallel to the common linkage when gates 90*a* and 90*b* are in the open position and rotate into a mainly perpendicular position to the common linkage when gates 90*a* and 90*b* are in the closed position. Additional secondary links (not expressly shown) can be added to carry heavier loads between gates 90*a* and 90*b* and the common central linkage such as bar 162. Multiple gate arc travel (not expressly shown) can be accomplished by changing the secondary linkages lengths.

Figure 13:
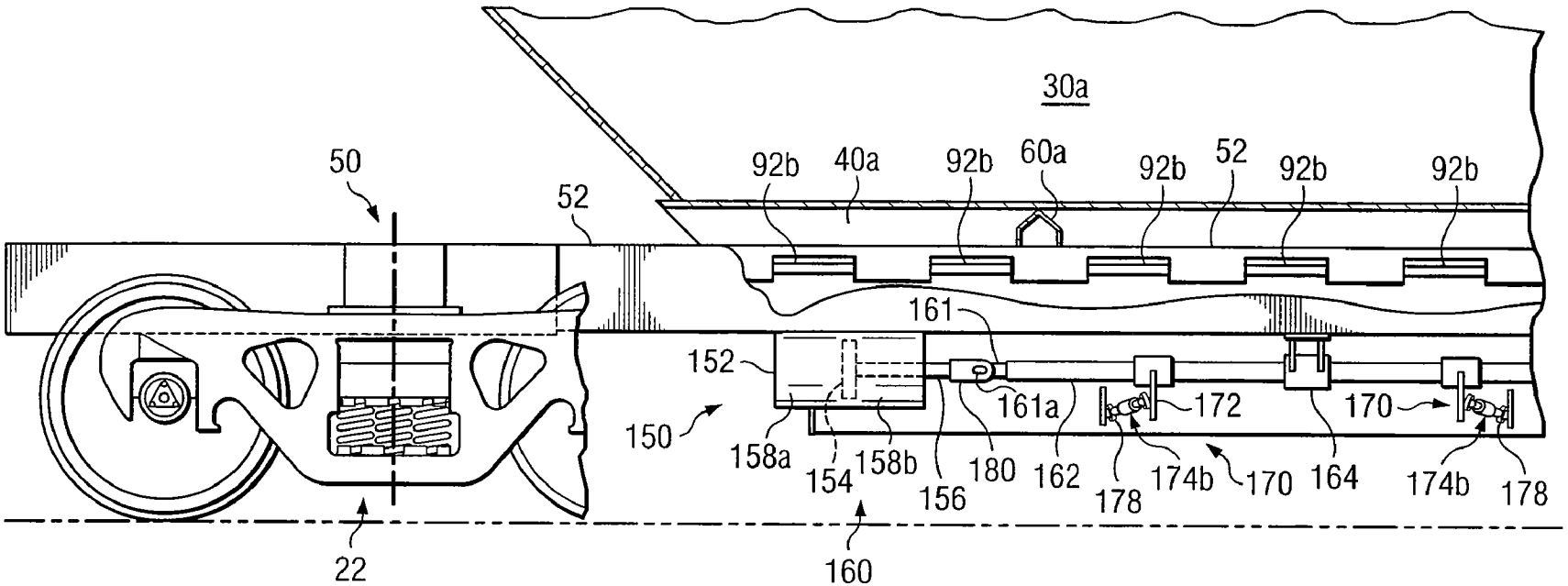
FIG. 13 is a schematic drawing in section with portions broken away showing one example of an operating mechanism satisfactory for moving door assemblies incorporating teachings of the present invention between a first, closed position and a second, open position.
Figure 14:
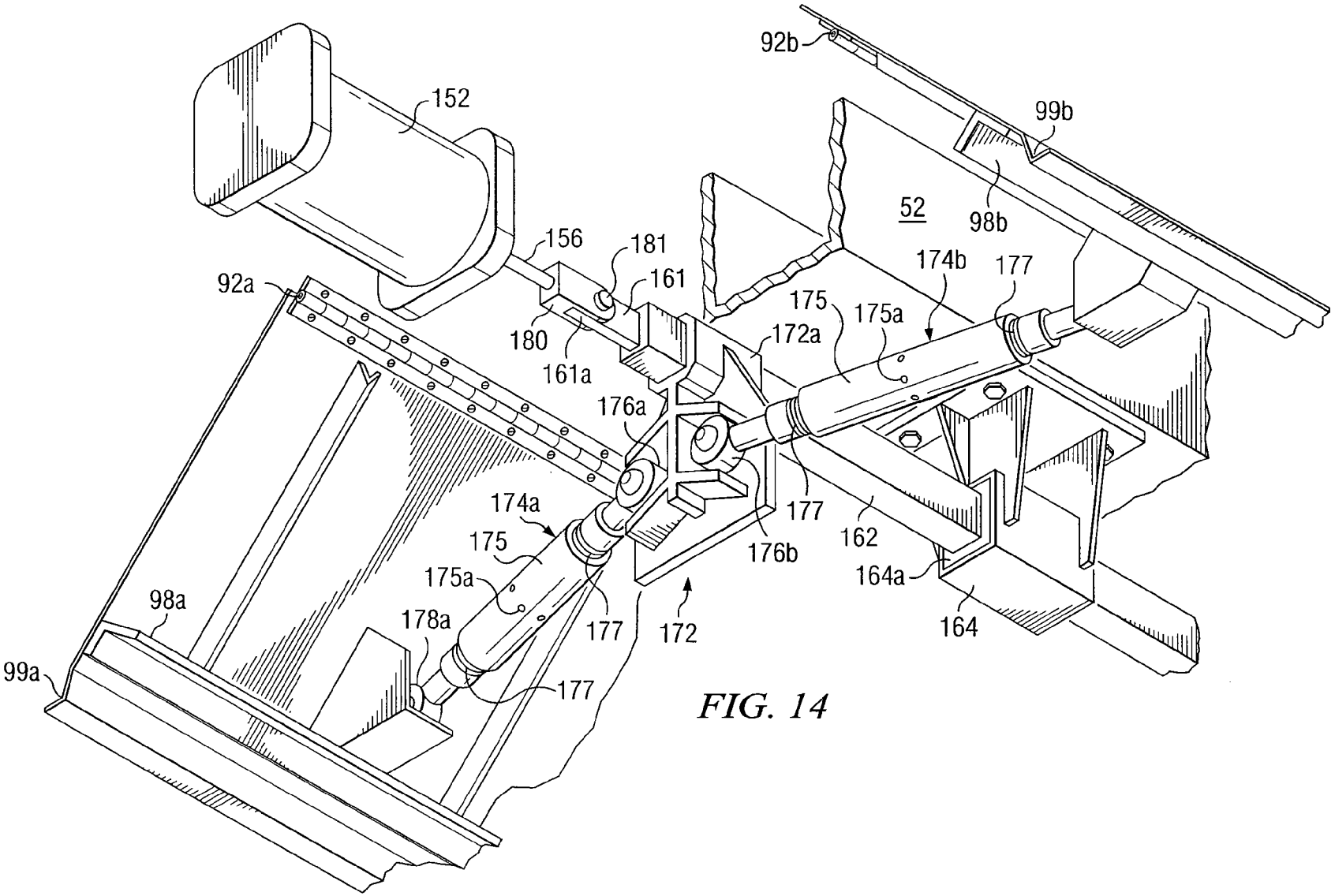
FIG. 14 is an schematic drawing showing an isometric view with portion broken away of the operating mechanism of FIG. 13.

As shown in FIGS. 1, 3, 4, 6, 7, 9-11, 13, 14 and 16A-16C, operating assembly 150 preferably includes air cylinder 152 with piston 154 and piston rod 156 slidably disposed therein. Piston 154 divides the interior of air cylinder 152 into two variable volume fluid chambers 158*a* and 158*b*. Air pressure may be applied to chamber 158*a* or 158*b*. Air pressure may be released from or vented from the other variable volume fluid chamber 158*a* or 158*b* to move or reciprocate piston rod 156 longitudinally relative to center sill 52 and other components associated with railway car underframe 50 as shown in FIGS. 13 and 14.

Typically, air cylinder 152 is formed proximate to a lower portion of the hopper such as proximate center sill 52. However, air cylinder 152 may be formed, located, placed, coupled or disposed with any portion of hopper car 20. In one embodiment of the present invention, air cylinder 152 is located beneath center sill 52.

In alternate embodiments of the present invention, operating assembly 150 may replace or supplement air cylinder 152 with any suitable drive actuator for providing a reciprocating longitudinally movement relative to center sill 52 and other components associated with railway car underframe 50. For example, operating assembly 150 may include an electrically operated motor (not expressly shown). Other examples of drive actuators including, but not limited to, hydraulic actuators, pneumatic actuators, electric actuators, manual actuators such as geared drives, and any other suitable drive actuators.

Figure 15:
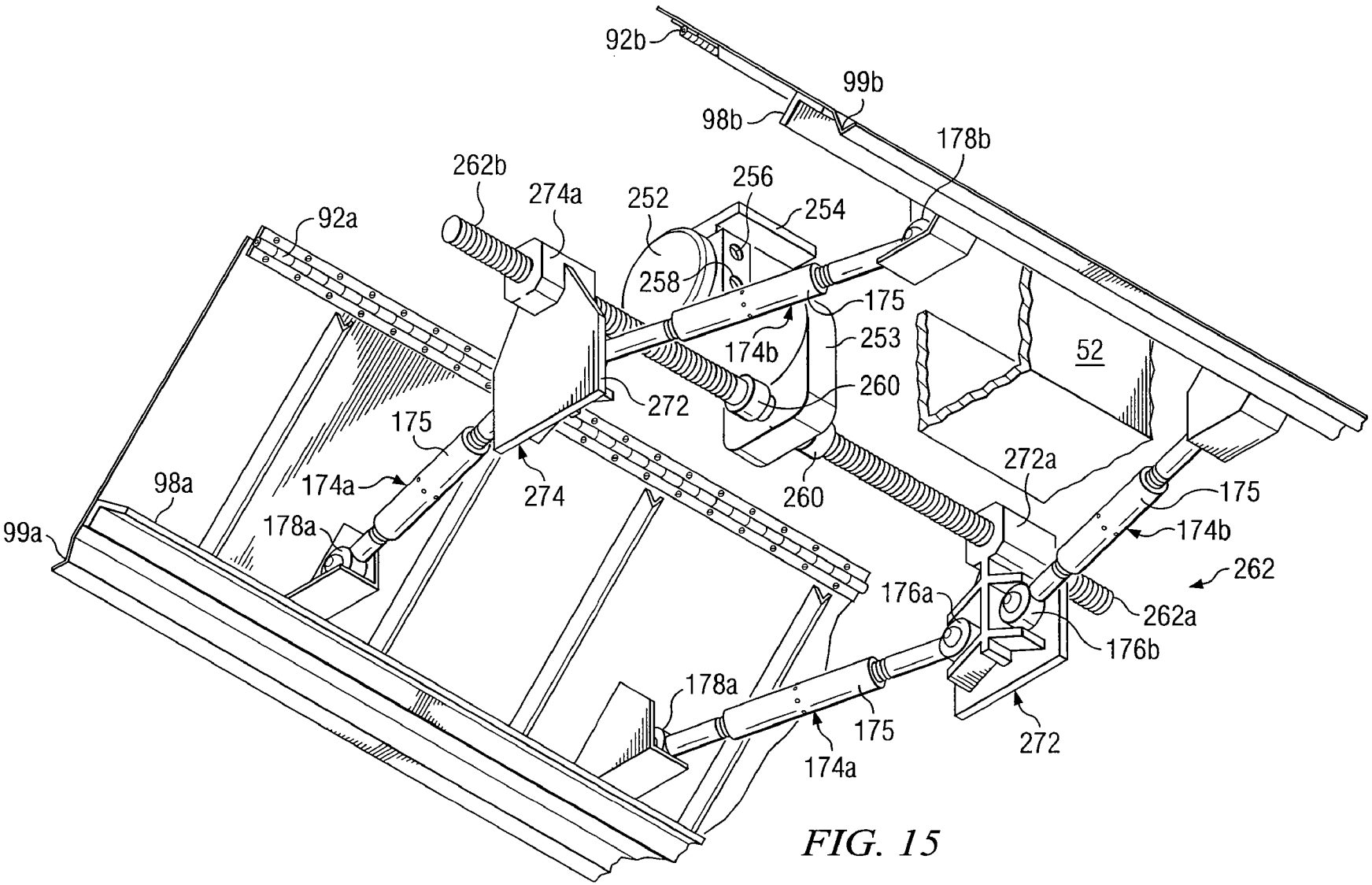
FIG. 15 is an schematic drawing showing an isometric view with portion broken away of another example of an operating mechanism satisfactory for moving door assemblies incorporating teachings of the present invention between a first, closed position and a second, open position.

On example of an alternate operating assembly may include, operating mechanism 250 satisfactory for moving door assemblies 90*a* and 90*b* between a first, closed position and a second, open position, as shown in FIG. 15. Operating mechanism 250 preferably includes motor 252 such as a hydraulic motor. Motor 252 may include inlet port 256 and outlet port 258 for providing power to drive motor 252. Motor 252 may further be coupled to center sill 52 using attachment plate 254.

Railcar 20 preferably includes gearbox 253 that may couple with motor 252. Typically, gearbox 253 provides a mechanical advantage to for turning or moving bar 262. As such, gearbox 253 may use motor coupler 260 for coupling or connecting motor 252 via gearbox 253 with bar 262.

In some embodiments, a detached motor (not expressly shown) drives gearbox 253. Generally, detached motor couples onto a drive shaft (not expressly shown) extending from gearbox 253 that provides the rotational movement for moving bar 262. In other embodiments, gearbox 253 is able to receive a motor drive shaft (not expressly shown) extending from the detached motor that is able to drive gearbox 253. In further embodiments, detached motor may include a manual actuation in which a person is used to drive gearbox 253 for opening and closing door assemblies 90.

Bar 262 generally interacts with boss 272*a* and 274*a* via attachment point 272*a* and 274*a* using threads (not expressly shown). As such, bar 262 may be able to provide a torsional movement that is converted into a longitudinal movement of boss 272 and 274 via the threads interacting inside of boss 272 and 274.

In some embodiments, bar 262 may be formed in two sections, namely bar 262*a* and bar 262*b*. Because bars 262*a* and 262*b* may coupled to motor 252 via gearbox 253, bars 262*a* and 262*b* may rotate in a similar direction. Thus, bars 262*a* and 262*b* may differ using reverse threading.

Reverse threading on one of bars 262*a* and 262*b* may cause boss 274 to be driven in an opposite direction. For example, bar 262*a* may include reverse threading and couple with boss 274 at attachment 274*a*. However, bar 262*b* may not include reverse threading and couple with boss 272 at attachment 272*a*. By rotating bar 262 in a common direction, boss 272 and 274 may be driven in opposite directions. In one embodiment, boss 272 and boss 274 are driven towards each other to cause door assemblies 90 via arms 174 to move to a closed position. Similarly to operating mechanism 150, operating mechanism 250 may include over-center locking position.

Drive actuator such as air cylinder 152 and motor 252 may move and maintain door assemblies 90 at an intermediate position generally between the closed position and the open position. For example, the position of door assemblies 90 as shown in FIG. 16B may illustrate one example embodiment of maintaining the door assemblies 90 in an intermediate position. In other embodiments, a stop (not expressly shown) may couple to a portion of a primary link such as bar 162 and 262 for maintaining door assemblies 90 at a partially open position or intermediate position.

One end of piston rod 156 is preferably connected to for fitted with clevis 180 that connects with an adjacent end of plank or connector plate 161. For embodiments of the invention as shown in FIGS. 13 and 14, connector plate or plank 161 preferably includes a connection end that interconnect with clevis 180 such as with pin 181 inserted through eye 161*a* of plank 161. The opposing end of connector plank 161 includes a generally rectangular cross section that connects to bar 162. For some applications connector plank 161 may extend along substantially the full length of discharge controlled system 160 longitudinally relative to center sill 52. For other applications two or more operating assemblies may be coupled with center sill 52 in accordance with teachings of the present invention. In yet other applications, connector plank 161 may form a part of bar 162 such that bar 162 connects directly with clevis 180.

Connectors or brackets 164 may be attached with center sill 52 and respectively engaged with bar 162. Generally, the dimensions of bracket 164 are preferably selected to allow bar 162 to slide or move within bracket 164 longitudinally with respect to center sill 52. Bracket 164 may be used to maintain bar 162 within a respective distance from center sill and in alignment with respect to center sill 52 and door assembly 90. In some embodiments, an insert member 164*a* may be disposed between bar 162 and bracket 164 to reduce the friction of the sliding motion.

For embodiments of the present invention as shown in FIGS. 3, 9, 10, 13, 14 and 16A-16C, each door 90*a* and 90*b* may include one or more respective door connector assemblies 170. Each door connector assembly 170 preferably includes a respective boss or socket 172 attached with bar 162 at coupling point 172*a* opposite from center sill 52. Each door connector assembly 170 also preferably includes a pair of arms 174*a* and 174*b* which may extend laterally from operating assembly 150 to engage respective longitudinal door assemblies 90*a* and 90*b*.

Generally, arms 174*a* and 174*b* are adjustable in length. For example, arms 174*a* and 174*b* may include turnbuckle 175 forming a part of arms 174*a* and 174*b*. Turnbuckle 175 preferably engages with threads 177 formed on arms 174*a* and 174*b*. By rotating turnbuckle 175 using notches 175*a*, turnbuckle 175 may extend or contract the length of arms 174*a* or 174*b*. As such, the position of door assemblies 90 in either the open or closed position may be adjusted. Generally, turnbuckle 175 adjust the length of arms 174*a* and 174*b* to provide sufficient closure of door assemblies 90. However, in some embodiments, turnbuckle 175 may adjust the length of arms 174*a* and 174*b* such that the open position of door assemblies 90 varies.

First end 176*a* and 176*b* of each arm 174*a* and 174*b* preferably includes a respective ball joint (not expressly shown) which may be rotatably engaged with socket or boss 172. Second end 178*a* and 178*b* of each arm 174*a* and 174*b* may be rotatably engaged with each door assembly 90*a* and 90*b* opposite from associated hinges spaced from respective hinges 92*a* and 92*b*. Arms 174 may rotate in three dimensions such as longitudinal, lateral and vertical relative to the associated center sill 52 (generally referred to as having a three-degree of range of motion mechanical linkage) FIG. 16B illustrates door assembly 90 in a partially open position such that arms 174*a* and 174*b* are controlling the movements of door assembly 90 throughout their range of motion.

Discharge control system 160 incorporating teachings of the present system may operate gates or doors 90 by pushing or pulling with air cylinder 152, hydraulic cylinder 252 or other type of actuator a common linkage centered under center sill 52 of railcar 20 or highway truck longitudinally. The common linkage may be attached to secondary linkages that connect to the door assemblies or gates 90 on both sides that swing or pivot open and closed depending on the direction of the common linkage. The gates 90 may be hinged proximate center sill 52 or other centrally located structure with hinges 92 oriented longitudinally and proximate the common linkage. Each secondary linkage provides the lower horizontal leg of a triangular shaped mechanism consisting of gate 90 as the hypotenuse and the common linkage and centrally located structure or center sill 52 as the upright leg in a closed position. The secondary linkages may be pushed or pulled past center to provide a positive lock or over-center lock on gate 90. The secondary linkages may be symmetrical to each other and provide an equilibrium of the transverse forces both while operating and in a locked position.

Only relatively simple adjustments are required such as lengthening or shortening secondary linkages until respective gates 90 are closed with sufficient preload or force. As such, over-center lock may be adjusted by a stop (not expressly shown) at the end of the common linkage such as bar 162 and 262 which can be adjusted longitudinally to increase or decrease the desired travel of the common linkage. The secondary linkages rotate into a compound angle mainly oriented in the longitudinal direction parallel to the common linkage when gates 90 are in the open position and rotate into a mainly perpendicular position to the common linkage when the gates are in the closed position. Additional secondary links can be added to carry heavier loads between gates 90 and the common central linkage. Multiple gate arc travel can be accomplished by changing the secondary linkages lengths.

Discharge control system 160 incorporating teachings of the present invention may be used on highway trucks, railcars, and other equipment requiring longitudinal gate(s). Additionally, discharge control system 160 may operate multiple gates swinging in opposite directions with a common linkage such as bar 162 and 262 extending generally perpendicular to the direction of both gate swings using a common air cylinder or actuator. Further, discharge control system 160 incorporating teachings of the present invention may be easily adapted to various commodities and gate sizes by adding or deleting secondary linkages.

Figure 16A:
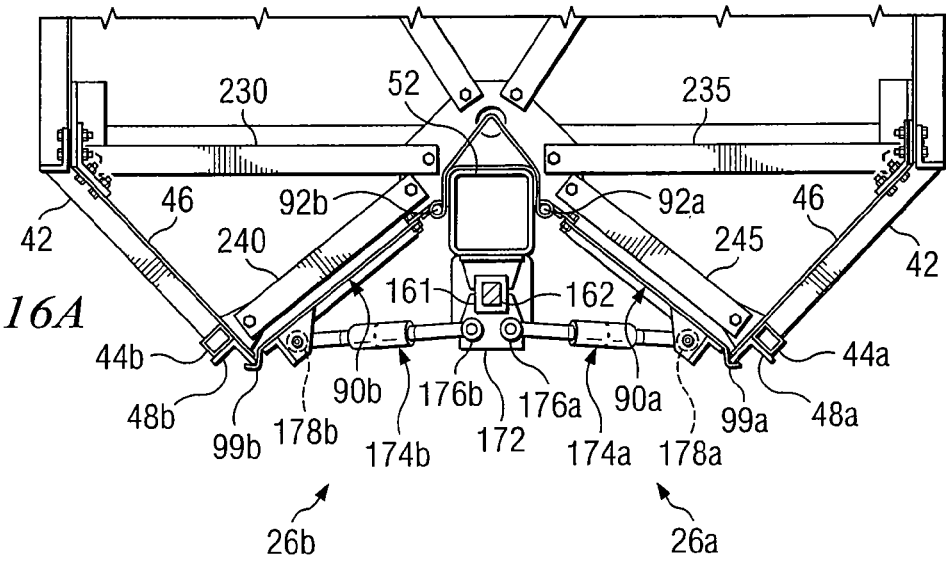
FIGS. 16A through 16C are enlarged schematic drawings in section with portions broken away showing one example of the longitudinal discharge openings and respective door assemblies moving between a first, closed position and a second, open position.
Figure 16B:
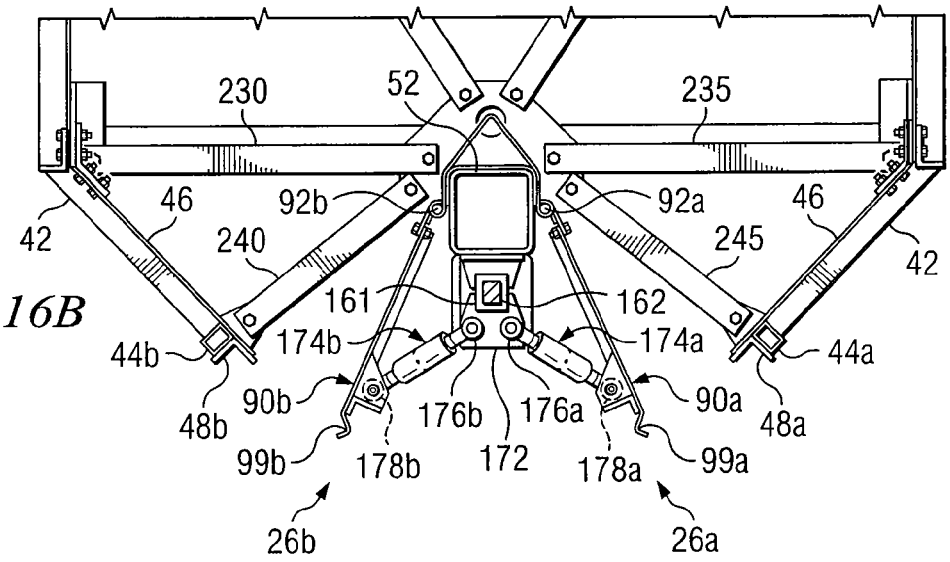
Figure 16C:
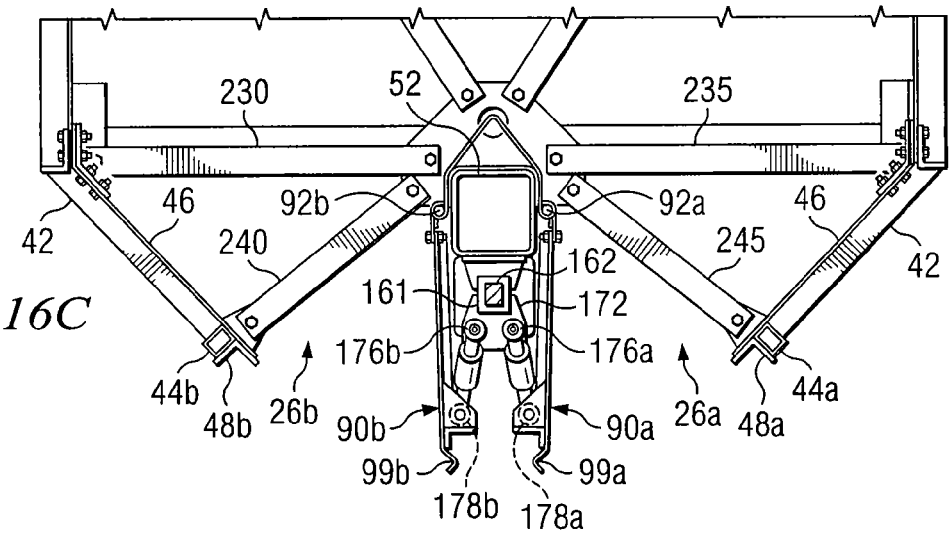

Referring to FIGS. 16A through 16C, longitudinal movement of bar 162 will result in radial extension of arms 174*a* and 174*b* to move door assembly 90*a* and 90*b* from their second, open position (see FIGS. 4, 11 and 16C) to their first, closed position (see FIGS. 3, 6, 9 and 16A). Movement of bar 162 in the opposite direction relative to center sill 52 will result in pulling or moving door assemblies 90*a* and 90*b* from their first position to their second, open position which allows rapid discharge of any lading contained within railway hopper car 20 as shown in FIG. 16C.

Although the present invention and its advantages have been described in detail, it should be understood that various changes, substitutions and alternations can be made herein without departing from the spirit and scope of the invention as defined by the following claims.

What is claimed is:

1. A method of forming a discharge control system for a railway car having a pair of longitudinal discharge openings disposed along opposite sides of a center sill of the railway car comprising:

forming a common linkage operable to be centered completely beneath the center sill of the railway car;

forming a plurality of secondary linkages operable to rotate between generally parallel to the common linkage to generally perpendicular to the common linkage, with each secondary linkage having a first end operable to be rotatably engaged with the common linkage and a second end operable to be rotatably engaged with a door assembly pivotally hinged to one side of the center sill of the railway car;

forming an operating assembly operable to be engaged with the common linkage and to move the common linkage longitudinally relative to the center sill; and forming brackets operable to be connected with the center sill of the railway car and to allow portions of the common linkage to move longitudinally within each bracket relative to a respective distance from the center sill.

2. The method of claim 1 further comprising forming the operating assembly with a gearbox operable to receive a motor drive shaft from a detached motor.

3. The method of claim 1 further comprising forming the operating assembly with a drive actuator selected from the group consisting of an air cylinder, an electrically operated motor, an electrical actuator, a hydraulic actuator or a manual actuator.

4. The method of claim 1 further comprising driving the common linkage between the closed and open position with an air cylinder.

5. The method of claim 1 further comprising driving the common linkage between the closed and open position with a motor.

6. The method of claim 1 further comprising:

moving the linkage attached to and supported by the center sill, extending along a generally longitudinally axis of the railway car;

rotating respective arms coupled with each discharge door assembly in three dimensions relative to the center sill; and pivoting each discharge door assembly hinged to the center sill between a first, closed position and a second, open position in response to the movement of the respective arms.

7. The method of claim 1, further comprising preventing discharge of lading from the discharge door assembly in the closed position using over-center locking to prevent the release of lading from the railway car.

8. The method of claim 1 further comprising moving the common linkage with a motor to open and close each discharge door assembly.

9. The method of claim 1 further comprising forming a part of each secondary linkage with a respective turnbuckle operable to adjust opening and closing of an associated discharge door assembly.

10. A method of forming a discharge control system for a railway car having a pair of longitudinal discharge openings disposed along opposite sides of a center sill of the railway car comprising:

forming a common linkage centered under the center sill of the railway car;

forming a plurality of secondary linkages operable to rotate between generally parallel to the common linkage to generally perpendicular to the common linkage, with each secondary linkage having a first end rotatably engaged with the common linkage and a second end rotatably engaged with a door assembly pivotally hinged to one side of the center sill of the railway car;

forming an operating assembly engaged with the common linkage and operable to move the common linkage longitudinally relative to the center sill;

forming brackets connected with the center sill of the railway car and operable to allow portions of the common linkage to move longitudinally within each bracket relative to a respective distance from the center sill;

forming the operating assembly with a gearbox coupled to the common linkage and operable to move the common linkage; and forming the gearbox to receive a motor drive shaft from a detached motor.

* * * * *